US008486292B2

(12) United States Patent
Kieburg et al.

(10) Patent No.: US 8,486,292 B2
(45) Date of Patent: Jul. 16, 2013

(54) MAGNETORHEOLOGICAL FORMULATION

(75) Inventors: Christoffer Kieburg, Maxdorf (DE); Jürgen Pfister, Speyer (DE); Claus Gabriel, Griesheim (DE); Günter Oetter, Frankenthal (DE); Martin Laun, Mannheim (DE); Rene Lochtman, Mannheim (DE)

(73) Assignee: BASF SE (DE)

( * ) Notice: Subject to any disclaimer, the term of this patent is extended or adjusted under 35 U.S.C. 154(b) by 436 days.

(21) Appl. No.: 12/442,463

(22) PCT Filed: Sep. 18, 2007

(86) PCT No.: PCT/EP2007/059830

§ 371 (c)(1),
(2), (4) Date: Mar. 23, 2009

(87) PCT Pub. No.: WO2008/034820

PCT Pub. Date: Mar. 27, 2008

(65) Prior Publication Data

US 2009/0289214 A1 Nov. 26, 2009

Related U.S. Application Data

(60) Provisional application No. 60/826,668, filed on Sep. 22, 2006.

(30) Foreign Application Priority Data

Sep. 22, 2006 (EP) ..... 06121112

(51) Int. Cl.
*H01F 1/44* (2006.01)

(52) U.S. Cl.
USPC ..... 252/62.52

(58) Field of Classification Search
USPC ..... 252/62.52
See application file for complete search history.

(56) References Cited

U.S. PATENT DOCUMENTS

| | | | | |
|---|---|---|---|---|
| 5,354,488 | A | 10/1994 | Shtarkman et al. | |
| 5,547,049 | A | 8/1996 | Weiss et al. | |
| 5,667,715 | A | 9/1997 | Foister | |
| 5,683,615 | A | 11/1997 | Munoz | |
| 6,132,633 | A | 10/2000 | Carlson | |
| 6,245,253 | B1 | 6/2001 | Grasshoff et al. | |
| 6,531,270 | B1 * | 3/2003 | Olson et al. | 430/391 |
| 6,942,957 | B2 * | 9/2005 | Ray et al. | 430/271.1 |
| 7,351,339 | B2 | 4/2008 | Maase et al. | |
| 2002/0130305 | A1 | 9/2002 | Iyengar et al. | |
| 2003/0047705 | A1 | 3/2003 | Iyengar et al. | |
| 2004/0084651 | A1 | 5/2004 | Kintz et al. | |
| 2004/0140447 | A1 | 7/2004 | Kintz et al. | |
| 2005/0020857 | A1 | 1/2005 | Volland et al. | |
| 2006/0033068 | A1 | 2/2006 | Cheng et al. | |
| 2008/0083606 | A1 | 4/2008 | Volland et al. | |
| 2009/0134354 | A1 * | 5/2009 | Dubois et al. | 252/62.55 |

FOREIGN PATENT DOCUMENTS

| | | | |
|---|---|---|---|
| EP | 1016806 | A2 | 7/2000 |
| EP | 1025373 | B1 | 4/2005 |
| FR | 2887680 | A1 | 12/2006 |
| JP | 2006-193686 | * | 7/2006 |
| JP | 2006193686 | A | 7/2006 |
| WO | WO-94/10691 | A1 | 5/1994 |
| WO | WO-94/10694 | A1 | 5/1994 |
| WO | WO-95/28719 | A1 | 10/1995 |
| WO | WO-97/15058 | A1 | 4/1997 |
| WO | WO-01/03150 | A1 | 1/2001 |
| WO | WO-2004/044931 | A3 | 5/2004 |
| WO | WO-2005035702 | A1 | 4/2005 |

OTHER PUBLICATIONS

Translation for JP 2006-193686.*
Altin, et al., "First Studies on the Rheological Behavior of Suspensions in Ionic Liquids," *Chem. Eng. Technol.*, (2006), vol. 29, No. 11, pp. 1347-1354.
Guerrero-Sanchez, et al., "Magnetorheological Fluids Based on Ionic Liquids," *Adv. Mater.*, (2007), vol. 19, pp. 1740-1747.
English translation of JP2006-253239.

* cited by examiner

*Primary Examiner* — Carol M Koslow
(74) *Attorney, Agent, or Firm* — Novak Druce Connolly Bove + Quigg LLP

(57) ABSTRACT

Magnetorheological formulations, processes for preparing the same and uses therefor, the formulations comprising: (a) an ionic liquid comprising anions and cations, and (b) dispersed magnetizable particles having a mean diameter of 0.1 to 500 μm; wherein the ionic liquid comprises one or more salts selected from the group consisting of 1-butyl-3-methylimidazolium methylsulfate, 1-ethyl-3-methylimidazolium ethylsulfate, 1-ethyl-3-methyl-imidazolium thiocyanate, 1-butyl-3-methylimidazolium thiocyanate, 1-ethyl-3-methyl-imidazolium acetate, 1-butyl-3-methylimidazolium acetate, 1-ethyl-3-methylpyridinium ethylsulfate, 1-ethyl-3-methylimidazolium dicyanamide, 1-butyl-3-methylimidazolium tetrafluoroborate, 1-hexyl-3-methylimidazolium tetrafluoroborate, 1-methyl-3-octylimidazolium tetrafluoroborate, 1-methyl-3-octylimidazolium hexafluorophosphate, 1-ethyl-3-methylimidazolium hexafluorophosphate, 1-hexyl-3-methylimidazolium hexafluorophosphate, methyltrioctylammonium bis(trifluoromethylsulfonyl) imide, 1-ethyl-3-methylimidazolium 2-(2-methoxyethoxy) ethylsulfate and mixtures thereof.

19 Claims, No Drawings

MAGNETORHEOLOGICAL FORMULATION

CROSS-REFERENCE TO RELATED APPLICATIONS

This application is a national stage application, under 35 U.S.C. §371, of PCT/EP2007/059830 filed Sep. 18, 2007, which claims benefit of European Patent Application No. 06121112.4, filed Sep. 22, 2006 and U.S. Provisional Patent Application No. 60/826,668, filed Sep. 22, 2006.

BACKGROUND OF THE INVENTION

Magnetorheological formulations (abbreviation: MRF) are generally designated as formulations which change their rheological properties under the action of a magnetic field. They are generally suspensions of ferromagnetic, superparamagnetic or paramagnetic particles in a liquid.

If such a suspension is exposed to a magnetic field, its flow resistance increases. This is caused by the fact that, owing to their magnetic interaction, the dispersed magnetizable particles, for example iron particles, form chain-like structures along the magnetic field lines. During the shearing of an MRF, these structures are partly destroyed but form again. The rheological properties of a magnetorheological formulation in a magnetic field resemble the properties of a plastic body having a flow limit, i.e. it is necessary to apply a minimum shear stress in order to cause the magnetorheological formulation to flow.

High transmittable shear stresses are required for the use of magnetorheological formulations in controllable apparatuses, such as shock absorbers, clutches, brakes and other devices (for example haptic devices, crash absorbers, steer-by-wire steering systems, gear- and brake-by-wire systems, seals, retaining systems, prostheses, fitness devices and bearings).

Known applications of magnetorheological liquids are described, for example, in U.S. Pat. No. 5,547,049, in EP 1 016 806 B1 or in EP 1 025 373 B1.

Formulations according to the prior art which are known to the person skilled in the art use hydrocarbons, for example alkanes, alkenes, poly-α-olefins (PAO) or esters, polyesters, silicone oils, polyalkylene glycols or water as a base liquid. Carbonyl iron powder—spherical iron particles having a size of from 1 to 30 μm—is frequently used as the magnetic component, although particles of other alloys (WO 94/10691) or having an irregular form are also described (WO 04/044931 or US 2004/140447).

Good suitability for use of a magnetorheological formulation demands a low tendency to sedimentation with the magnetizable particles used in the liquid. If sediments occur, they must be capable of being easily stirred, i.e. easily redispersed, in order to avoid adversely influencing the functioning of the apparatuses in which the magnetorheological formulation is used. The formation of agglomerates and hard sediments which are no longer redispersible can be completely or partly overcome by using suitable dispersants. As a rule, polymers or surfactants are used for this purpose. U.S. Pat. No. 5,683,615 describes the use of thiophosphorus and/or thiocarbamate compounds as dispersants for magnetizable particles for improving the colloid stability. US 2004/0084651 describes oleates, naphthenates, sulfonates, phosphate esters, laurates, stearates, e.g. lithium hydroxystearate, stearic acid, glyceryl monooleate and fatty alcohols as dispersants. US 2002/0130305 mentions ethoxylated alkylamines, such as, for example, tallow fatty amine ethoxylate, as preferred surfactants. US 2003/0047705 claims ethoxylated and propoxylated alkylamines.

In addition, the known magnetorheological formulations generally comprise a thixotropic agent which establishes a flow limit and thus counteracts sedimentation of the particles. The sediment hardness is reduced and the redispersibility of particles which have already settled out is facilitated by such additives. The prior art is the use of hydrophobically modified sheet silicates of the smectite type, particularly of the montmorillonite type (WO 01/03150 A1), a main constituent of bentonite, of silica gel or of disperse silica (U.S. Pat. No. 5,667,715) in nonpolar liquids. The use of carbon particles (U.S. Pat. No. 5,354,488) or of polyureas for this purpose (DE 196 54 461 A1) is also known.

Water-based magnetorheological formulations are described in U.S. Pat. No. 6,132,633 and comprise hydrophilic sheet silicates of the bentonite or hectorite type. Laponite, a synthetic sheet silicate similar to hectorite, is also mentioned for this intended use.

The transmittable shear stress of a magnetorheological formulation increases with the proportion by weight of the magnetizable particles. For individual applications, proportions by weight of the magnetizable particles of 90% or more are absolutely desirable. Strategies for maximizing the proportions by weight and hence the transmittable shear stress in a field relate to the fine tuning of the particle sizes, possibly the use of particle diameters of different magnitude (WO 97/15058). U.S. Pat. No. 5,667,715 relates to a mixture of large and small iron particles for maximizing the ratio of the transmittable shear stress in a magnetic field to the transmittable shear stress without a magnetic field. However, the close packing of magnetizable particles and the intrinsic viscosity or shear stress increasing with the degree of pigmentation constitute a limiting factor in every case. US patent application US 2006/0033068 therefore describes magnetorheological formulations having proportions of magnetizable particles which possess a special geometry. These particles in the form of lamellae, needles or cylinders or in an egg shape align themselves in the direction of flow of a liquid without influences of a magnetic field and therefore have a lower intrinsic viscosity with comparable maximum shear stress in a field in comparison with magnetorheological formulations comprising, for example, spherical particles.

A further strategy for maximizing the achievable shear stresses is the removal of troublesome impurities on the particle surfaces (WO 94/10694 or WO 95/28719) or the use of certain alloys (WO 94/10691).

It is known to the person skilled in the art that the polarity of a liquid present in the magnetorheological formulation plays a role in influencing the shear stresses achievable with the magnetorheological formulation in a magnetic field. Thus, poly-α-olefin-based magnetorheological formulations show lower shear stresses than silicone-based MR formulations or even aqueous systems. Polar additives to the liquid component of a magnetorheological formulation can contribute toward improved shear stresses.

Conventional polar liquids present in magnetorheological formulations, such as, for example, water or polyalkylene glycols, however, show an excessively high viscosity or solidification at low temperatures below −20° C. and are therefore eliminated for suitable magnetorheological formulations which have a high ratio of transmittable shear stress in a magnetic field to transmittable shear stress without a magnetic field.

Another, previously unsolved problem is the poor thermal stability of the liquid present in the magnetorheological formulation. Thus, a multiplicity of the known magnetorheological formulations which have a low viscosity at low temperatures and can therefore be used, for example, for the automotive sector is stable over a relatively long period only at temperatures up to 100° C., whereas there is no longer sufficient stability at higher temperatures up to 150° C., whether because of evaporation loss or because of chemical change in the liquid present in the magnetorheological formulation. In this context, "stable" is understood as meaning that the performance characteristics do not deteriorate as a result of thermal load. These are firstly the rheological properties, i.e. the flow behavior without a magnetic field and under the influence of a magnetic field. Secondly, the formulations should show no instabilities or inhomogeneities after being subjected to a thermal load for a relatively long time, such as agglomeration or pronounced sedimentation, for example with formation of hard sediments which are no longer redispersible, which is due inter alia to the partial or complete loss of function of the dispersant. Frequently, the liquids having a low viscosity at low temperatures and present in the magnetorheological formulation have too high a vapor pressure at temperatures above 150° C. Evaporation of liquid fractions at high operating temperatures and hence thickening of the magnetorheological formulation are the result. The known magnetorheological formulations comprising liquids which can be exposed to high operating temperatures of more than 170° C. without adversely affecting the life of the magnetorheological formulation are too highly viscous, solidify in amorphous form or crystallize at temperatures below −20° C. even without application of a magnetic field.

A disadvantage of the known magnetorheological formulations is that they frequently do not have the desired combination of properties for the respective fields of use. The individual components of the formulations—e.g. base liquid, viscosity modifier, magnetizable particles, dispersant, thickener, corrosion inhibitors and lubricant and others—should be tailored to one another for many applications so that, in spite of the high volume fractions of magnetizable particles, the usability of the formulation is ensured. This is understood as meaning the flowability of the formulations over a broad temperature range of, for example, from −40° C. to 200° C., as low a viscosity level as possible without the action of a magnetic field, as high a transmittable shear stress as possible in a magnetic field, little sedimentation of the magnetizable particles, little tendency to aggregation and easy redispersibility after sedimentation. Another important property is high stability of the magnetorheological formulation to energy inputs which results from use. The energy is input by high shearing with and without magnetic field and manifests itself in high fluid temperatures, abrasion and physical and chemical fluid changes.

BRIEF SUMMARY OF THE INVENTION

The present invention relates to a magnetorheological formulation comprising magnetizable particles dispersed in a liquid, processes for the preparation of the magnetorheological formulation and the use thereof.

It is therefore an object of the present invention to provide a magnetorheological formulation which avoids the disadvantages of the prior art and which has as many as possible of the abovementioned properties desired for a certain application.

In particular, the magnetorheological formulation should be capable of being used over a large temperature range; for example, in particular variants, it should be liquid at −40° C. and capable of being exposed to temperatures above 150° C. without adversely affecting the usability. Furthermore, it is in particular an object of the invention to provide a magnetorheological formulation which can be redispersed without problems after sedimentation of the magnetizable particles and by means of which as high shear stresses as possible are transmittable on application of a magnetic field. Furthermore, the rheological properties of the magnetorheological formulation should change as little as possible both in the magnetic field and without application of a magnetic field after prolonged mechanical stress.

This object is achieved, according to the invention, by a magnetorheological formulation which comprises an ionic liquid comprising anions and cations, dispersed magnetizable particles having a mean diameter of from 0.1 to 500 μm and, if appropriate, additives.

The dispersed particles can be dispersed in a liquid which consists exclusively of the ionic liquid (100% by weight) or can be dispersed in a liquid which comprises further components, for example additives, in addition to the ionic liquid. Preferably, the ratio of the proportion by weight of the ionic liquid to the proportion by weight of the additives, based in each case on the total weight of the magnetorheological formulation, is greater than 1, particularly preferably greater than 2. All components of the magnetorheological formulation which are present therein in addition to the ionic liquid and the magnetizable particles are referred to as additives.

The formulation according to the invention, based on ionic liquids, comprises a liquid which has a completely novel composition and, in contrast to the liquids known from the prior art and present in magnetorheological formulations, does not substantially comprise hydrocarbons, esters, polyethers, polyesters, silicone oils or water.

Magnetorheological formulations according to the invention show very high shear stresses if they are exposed to a magnetic field. In comparison with a conventional magnetorheological formulation having a comparable shear stress, a lower degree of pigmentation (fewer magnetizable particles per volume) can be used in the magnetorheological formulation according to the invention, which in turn means a lower viscosity of the magnetorheological formulation without a magnetic field. In addition, the temperature dependence of the shear stress in the magnetic field is substantially less than that of magnetorheological formulations based on hydrophobic oils. Special magnetorheological formulations according to the invention are still flowable even at −40° C. and at the same time chemically stable at temperatures above 180° C. and have a very small evaporation loss. Owing to the polar character of ionic liquids, it is possible to dispense with surface-active additives or with dispersants when dispersing magnetizable particles having a hydrophilic surface, for example iron particles, so that chemical and physical changes in the magnetorheological formulation, which occur, for example, after long-term or permanent stress and are due to changes, for example, in the dispersant, do not take place. Accordingly, the transmittable shear stress of a magnetorheological formulation based on an ionic liquid with and without a magnetic field is virtually unchanged after continuous load tests, whereas magnetorheological formulations, for example based on poly-x-olefins, experience a change in the shear stress.

DETAILED DESCRIPTION OF THE INVENTION

Ionic liquids according to the present invention are liquid salts which are preferably liquid at temperatures below 100° C.

Ionic liquids in the context of the present invention are preferably (A) salts of the general formula (I)

$$[A]_n^+[Y]^{N-} \quad (I),$$

where n is 1, 2, 3 or 4, $[A]^+$ is a quaternary ammonium cation, an oxonium cation, a sulfonium cation or a phosphonium cation and $[Y]^{n-}$ is a monovalent, divalent, trivalent or tetravalent anion;

(B) mixed salts of the general formulae (II)

$$[A^1]^+[A^2]^+[Y]^{n-} \quad (IIa),$$

where n=2;

$$[A^1]^+[A^2]^+[A^3]^+[Y]^{n-} \quad (IIb),$$

where n=3; or $$[A^1]^+[A^2]^+[A^3]^+[A^4]^+[Y]^{n-} \quad (IIc),$$

where n=4 and where $[A^1]^+$, $[A^2]^+$, $[A^3]^+$ and $[A^4]^+$, independently of one another, are selected from the groups mentioned for $[A]^+$, and $[Y]^{n-}$ has the meaning mentioned under (A); or (C) mixed salts of the general formulae (III)

$$[A^1]^+[A^2]^+[A^3]^+[M^1]^+[Y]^{n-} \quad (IIIa),$$

where n=4;

$$[A^1]^+[A^2]^+[M^1]^+[M^2]^+[Y]^{n-} \quad (IIIb),$$

where n=4;

$$[A^1]^+[M^1]^+[M^2]^+[M^3]^+[Y]^{n-} \quad (IIIc),$$

where n=4;

$$[A^1]^+[A^2]^+[M^1]^+[Y]^{n-} \quad (IIId),$$

where n=3;

$$[A^1]^+[M^1]^+[M^2]^+[Y]^{n-} \quad (IIIe),$$

where n=3;

$$[A^1]^+[M^1]^+[Y]^{n-} \quad (IIIf),$$

where n=2;

$$[A^1]^+[A^2]^+[M^4]^{2+}[Y]^{n-} \quad (IIIg),$$

where n=4;

$$[A^1]^+[M^1]^+[M^4]^{2+}[Y]^{n-} \quad (IIIh),$$

where n=4;

$$[A^1]^+[M^5]^{3+}[Y]^{n-} \quad (IIIi)$$

where n=4; or $$[A^1]^+[M^4]^{2+}[Y]^{n-} \quad (IIIj),$$

where n=3 and where $[A^1]^+$, $[A^2]^+$ and $[A^3]^+$, independently of one another are selected from the groups mentioned for $[A]^+$, $[Y]^{n-}$ has the meaning mentioned under (A) and $[M^1]^+$, $[M^2]^+$, $[M^3]^+$ are monovalent metal cations, $[M^4]^{2+}$ are divalent metal cations and $[M^5]^{3+}$ are trivalent metal cations.

Preferably, the ionic liquids have a melting point of less than 180° C. Furthermore, the melting point is preferably below 150° C., more preferably below 120° C. and even more preferably below 100° C.

Compounds which are suitable for the formation of the cation $[A]^+$ of ionic liquids are disclosed, for example, in DE 102 02 838 A1. Thus, such compounds may comprise oxygen, phosphorus, sulfur or in particular nitrogen atoms, for example at least one nitrogen atom, preferably 1-10 nitrogen atoms, particularly preferably 1-5, very particularly preferably 1-3 and in particular 1-2 nitrogen atoms. If appropriate, further heteroatoms, such as oxygen, sulfur or phosphorus atoms, may also be present. The nitrogen atom is a suitable carrier of the positive charge in the cation of the ionic liquid, from which a proton or an alkyl radical can then pass over to the anion in equilibrium in order to produce an electrically neutral molecule.

Where the nitrogen atom is the carrier of the positive charge in the cation of the ionic liquid, a cation can first be produced by quaternization on the nitrogen atom, for example of an amine or a nitrogen heterocycle, in the synthesis of the ionic liquids. The quaternization can be effected by alkylation of the nitrogen atom. Depending on the alkylating reagent used, salts having different anions are obtained. Where it is not possible to form the desired anion in the quaternization itself, this can be effected in a further synthesis step. Starting, for example, from an ammonium halide, the halide can be reacted with a Lewis acid, a complex anion being formed from halide and Lewis acid. Alternatively, the exchange of a halide ion for the desired anion is possible. This can be effected by addition of a metal salt with precipitation of the metal halide formed, via an ion exchanger or by displacement of the halide ion by a strong acid (with liberation of the hydrohalic acid). Suitable processes are described, for example, in Angew. Chem. 2000, 112, pages 3926-3945 and the literature cited therein.

Suitable alkyl radicals with which the nitrogen atom in the amines or nitrogen heterocycles can, for example, be quaternized are $C_1$ to $C_{18}$-alkyl, preferably $C_1$ to $C_{10}$-alkyl, particularly preferably $C_1$ to $C_6$-alkyl and very particularly preferably methyl. The alkyl group may be unsubstituted or may have one or more identical or different substituents.

Preferred compounds are those which comprise at least one five- to six-membered heterocycle, in particular a five-membered heterocycle, which has at least one nitrogen atom and, if appropriate, an oxygen or sulfur atom; particularly preferred compounds are those which comprise at least one five- to six-membered heterocycle which has one, two or three nitrogen atoms and one sulfur or one oxygen atom, very particularly preferably those having two nitrogen atoms. Aromatic heterocycles are furthermore preferred.

Particularly preferred compounds are those which have a molecular weight below 1000 g/mol, very particularly preferably below 500 g/mol and in particular below 250 g/mol.

Furthermore, preferred cations are those which are selected from the compounds of the formulae (IVa) to (IVw), (IVa)

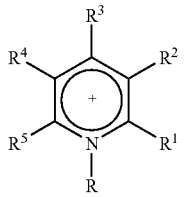

(IVb)

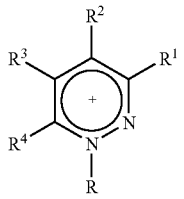

-continued
(IVc)
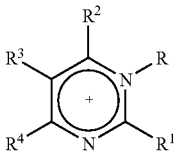
(IVd)
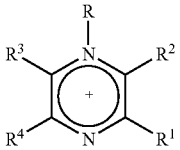
(IVe)
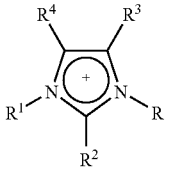
(IVf)
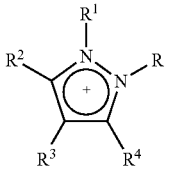
(IVg)
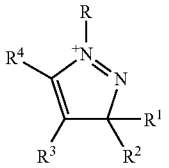
(IVg')
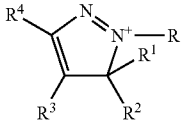
(IVh)
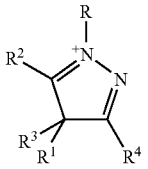
(IVi)
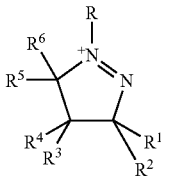
(IVj)
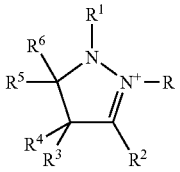
-continued
(IVj')
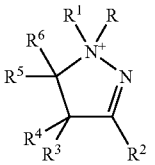
(IVk)
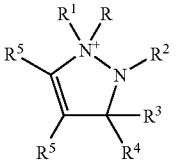
(IVk')
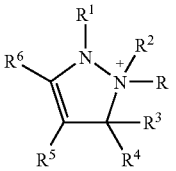
(IVl)
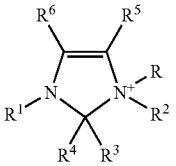
(IVm)
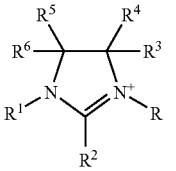
(IVm')
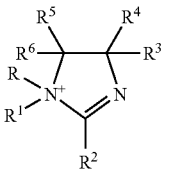
(IVn)
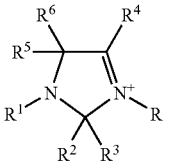
(IVn')
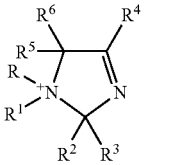
(IVo)
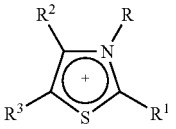

-continued (IVo′)

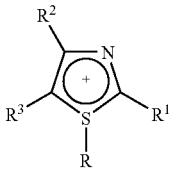

(IVp)

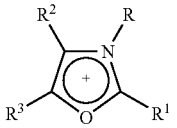

(IVq)

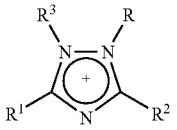

(IVq′)

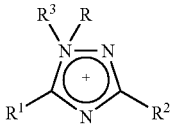

(IVq″)

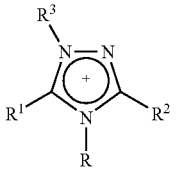

(IVr)

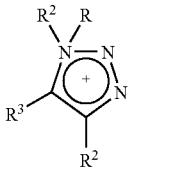

(IVr′)

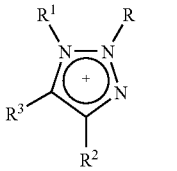

(IVr″)

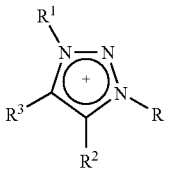

(IVs)

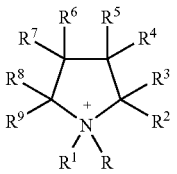

-continued (IVt)

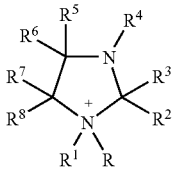

(IVu)

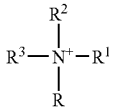

(IVv)

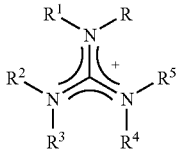

(IVw)

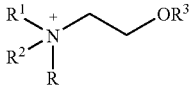

and oligomers which comprise these structures.

Further suitable cations are compounds of the general formulae (IVx) and (IVy)

(IVx)

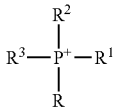

(IVy)

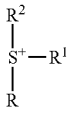

and oligomers which comprise this structure.

In the abovementioned formulae (IVa) to (IVy), the radical R is hydrogen, a carbon-comprising organic, saturated or unsaturated, acyclic or cyclic, aliphatic, aromatic or araliphatic radical which is unsubstituted or substituted or interrupted by 1 to 5 heteroatoms or functional groups and has 1 to 20 carbon atoms; and the radicals $R^1$ to $R^9$, independently of one another, are hydrogen, a sulfo group or a carbon-comprising organic, saturated or unsaturated, acyclic or cyclic, aliphatic, aromatic or araliphatic radical which is unsubstituted or substituted or interrupted by 1 to 5 heteroatoms or functional groups and has 1 to 20 carbon atoms, it being possible for the radicals $R^1$ to $R^9$, which are bonded to a carbon atom (and not to a heteroatom) in the abovementioned formulae (IV), additionally to be halogen or a functional group; or two neighboring radicals from the series $R^1$ to $R^9$ together are also a divalent, carbon-comprising organic, saturated or unsaturated, acyclic or cyclic, aliphatic, aromatic or araliphatic radical which is unsubstituted or substituted or interrupted by 1 to 5 heteroatoms or functional groups and has 1 to 30 carbon atoms.

In the definition of the radicals R and $R^1$ to $R^9$, suitable heteroatoms are in principle all heteroatoms which are capable of formally replacing a —$CH_2$—, a —CH═, a —C≡ or a ═C═ group. If the carbon-comprising radical comprises heteroatoms, oxygen, nitrogen, sulfur, phosphorus and silicon are preferred. In particular, —O—, —S—, —SO—, —$SO_2$—, —NR'—, —N═, —PR'—, —$PR'_2$ and —$SiR'_2$— may be mentioned as preferred groups, the radicals R' being the remaining part of the carbon-comprising radical. Where they are bonded to a carbon atom (and not to a heteroatom) in the abovementioned formulae (IV), the radicals $R^1$ to $R^9$ may also be bonded directly via the heteroatom.

Suitable functional groups are in principle all functional groups which can be bonded to a carbon atom or a heteroatom. —OH (hydroxyl), ═O (in particular as a carbonyl group), —$NH_2$ (amino), ═NH (imino), —COOH (carboxyl), —$CONH_2$ (carboxamido), —$SO_3H$ (sulfo) and —CN (cyano) may be mentioned as suitable examples. Functional groups and heteroatoms may also be directly neighboring so that combinations of a plurality of neighboring atoms, such as, for example, —O— (ether), —S— (thioether), —COO— (ester), —CONH— (secondary amide) or —CONR'— (tertiary amide), are also included, for example di($C_1$-$C_4$-alkyl) amino, $C_1$-$C_4$-alkyloxycarbonyl or $C_1$-$C_4$-alkyloxy.

Fluorine, chlorine, bromine and iodine may be mentioned as halogens.

The radical R is preferably straight-chain or branched $C_1$- to $C_{18}$-alkyl which is unsubstituted or monosubstituted to polysubstituted by hydroxyl, halogen, phenyl, cyano, $C_1$- to $C_6$-alkoxycarbonyl and/or sulfo and has altogether 1 to 20 carbon atoms, such as, for example, methyl, ethyl, 1-propyl, 2-propyl, 1-butyl, 2-butyl, 2-methyl-1-propyl (isobutyl), 2-methyl-2-propyl (tert-butyl), 1-pentyl, 2-pentyl, 3-pentyl, 2-methyl-1-butyl, 3-methyl-1-butyl, 2-methyl-2-butyl, 3-methyl-2-butyl, 2,2-dimethyl-1-propyl, 1-hexyl, 2-hexyl, 3-hexyl, 2-methyl-1-pentyl, 3-methyl-1-pentyl, 4-methyl-1-pentyl, 2-methyl-2-pentyl, 3-methyl-2-pentyl, 4-methyl-2-pentyl, 2-methyl-3-pentyl, 3-methyl-3-pentyl, 2,2-dimethyl-1-butyl, 2,3-dimethyl-1-butyl, 3,3-dimethyl-1-butyl, 2-ethyl-1-butyl, 2,3-dimethyl-2-butyl, 3,3-dimethyl-2-butyl, 1-heptyl, 1-octyl, 1-nonyl, 1-decyl, 1-undecyl, 1-dodecyl, 1-tetradecyl, 1-hexadecyl, 1-octadecyl, 2-hydroxyethyl, benzyl, 3-phenylpropyl, 2-cyanoethyl, 2-(methoxycarbonyl) ethyl, 2-(ethoxycarbonyl)ethyl, 2-(n-butoxycarbonyl) ethyl, trifluoromethyl, difluoromethyl, fluoromethyl, penta-fluoroethyl, heptafluoropropyl, heptafluoroisopropyl, nonafluorobutyl, nona-fluoroisobutyl, undecylfluoropentyl, undecylfluoroisopentyl, 6-hydroxyhexyl and propylsulfonic acid;

glycols, butylene glycols and oligomers thereof having 1 to 100 units and a hydrogen atom or a $C_1$- to $C_8$-alkyl as a terminal group, such as, for example, $R^AO$—$(CHR^B$—$CH_2$—$O)_n$—$CHR^B$—$CH_2$— or $R^AO$—$(CH_2CH_2CH_2CH_2O)_n$—$CH_2CH_2CH_2CH_2O$— where $R^A$ and $R^B$ are preferably hydrogen, methyl or ethyl and n is preferably from 0 to 3, in particular 3-oxabutyl, 3-oxapentyl, 3,6-dioxaheptyl, 3,6-dioxaoctyl, 3,6,9-trioxadecyl, 3,6,9-trioxaundecyl, 3,6,9,12-tetraoxamidecyl and 3,6,9,12-tetraoxatetradecyl;

vinyl; and

N,N-di-$C_1$- to $C_8$-alkylamino, such as, for example, N,N-dimethylamino and N,N-diethylamino.

The radical R is particularly preferably straight-chain and unsubstituted $C_1$- to $C_{18}$-alkyl, such as, for example, methyl, ethyl, 1-propyl, 1-butyl, 1-pentyl, 1-hexyl, 1-heptyl, 1-octyl, 1-decyl, 1-dodecyl, 1-tetradecyl, 1-hexadecyl, 1-octadecyl, in particular methyl, ethyl, 1-butyl and 1-octyl, and is $CH_3O$—$(CH_2CH_2O)_n$—$CH_2CH_2$— and $CH_3CH_2O$—$(CH_2CH_2O)_n$—$CH_2CH_2$— where n is from 0 to 3.

The radicals $R^1$ to $R^9$, independently of one another, are preferably hydrogen;

halogen;

a functional group;

$C_1$-$C_{18}$-alkyl optionally substituted by functional groups, aryl, alkyl, aryloxy, alkyloxy, halogen, heteroatoms and/or heterocycles and/or interrupted by one or more oxygen and/or sulfur atoms and/or one or more substituted or unsubstituted imino groups;

$C_2$-$C_{18}$-alkenyl optionally substituted by functional groups, aryl, alkyl, aryloxy, alkyloxy, halogen, heteroatoms and/or heterocycles and/or interrupted by one or more oxygen and/or sulfur atoms and/or one or more substituted or unsubstituted imino groups;

$C_6$-$C_{12}$-aryl optionally substituted by functional groups, aryl, alkyl, aryloxy, alkyloxy, halogen, heteroatoms and/or heterocycles;

$C_5$-$C_{12}$-cycloalkyl optionally substituted by functional groups, aryl, alkyl, aryloxy, alkyloxy, halogen, heteroatoms and/or heterocycles;

$C_5$-$C_{12}$-cycloalkenyl optionally substituted by functional groups, aryl, alkyl, aryloxy, alkyloxy, halogen, heteroatoms and/or heterocycles; or a five- or six-membered heterocycle optionally substituted by functional groups, aryl, alkyl, aryloxy, alkyloxy, halogen, heteroatoms and/or heterocycles and having oxygen, nitrogen and/or sulfur atoms; or two neighboring radicals together are an unsaturated, saturated or aromatic ring optionally substituted by functional groups, aryl, alkyl, aryloxy, alkyloxy, halogen, heteroatoms and/or heterocycles and optionally interrupted by one or more oxygen and/or sulfur atoms and/or one or more substituted or unsubstituted imino groups.

$C_1$- to $C_{18}$-Alkyl optionally substituted by functional groups, aryl, alkyl, aryloxy, alkyloxy, halogen, heteroatoms and/or heterocycles is preferably methyl, ethyl, 1-propyl, 2-propyl, 1-butyl, 2-butyl, 2-methyl-1-propyl (isobutyl), 2-methyl-2-propyl (tert-butyl), 1-pentyl, 2-pentyl, 3-pentyl, 2-methyl-1-butyl, 3-methyl-1-butyl, 2-methyl-2-butyl, 3-methyl-2-butyl, 2,2-dimethyl-1-propyl, 1-hexyl, 2-hexyl, 3-hexyl, 2-methyl-1-pentyl, 3-methyl-1-pentyl, 4-methyl-1-pentyl, 2-methyl-2-pentyl, 3-methyl-2-pentyl, 4-methyl-2-pentyl, 2-methyl-3-pentyl, 3-methyl-3-pentyl, 2,2-dimethyl-1-butyl, 2,3-dimethyl-1-butyl, 3,3-dimethyl-1-butyl, 2-ethyl-1-butyl, 2,3-dimethyl-2-butyl, 3,3-dimethyl-2-butyl, heptyl, octyl, 2-ethylhexyl, 2,4,4-trimethylpentyl, 1,1,3,3-tetramethylbutyl, 1-nonyl, 1-decyl, 1-undecyl, 1-dodecyl, 1-tridecyl, 1-tetradecyl, 1-pentadecyl, 1-hexadecyl, 1-heptadecyl, 1-octadecyl, cyclopentylmethyl, 2-cyclopentylethyl, 3-cyclopentylpropyl, cyclohexylmethyl, 2-cyclohexylethyl, 3-cyclohexylpropyl, benzyl (phenylmethyl), diphenylmethyl (benzhydryl), triphenylmethyl, 1-phenylethyl, 2-phenylethyl, 3-phenyl-propyl, α,α-dimethylbenzyl, p-tolylmethyl, 1-(p-butylphenyl)ethyl, p-chlorobenzyl, 2,4-dichlorobenzyl, p-methoxybenzyl, m-ethoxybenzyl, 2-cyanoethyl, 2-cyanopropyl, 2-methoxycarbonylethyl, 2-ethoxycarbonylethyl, 2-butoxycarbonylpropyl, 1,2-di-(methoxycarbonyl)ethyl, methoxy, ethoxy, formyl, 1,3-dioxolan-2-yl, 1,3-dioxan-2-yl, 2-methyl-1,3-dioxolan-2-yl, 4-methyl-1,3-dioxolan-2-yl, 2-hydroxyethyl, 2-hydroxy-propyl, 3-hydroxypropyl, 4-hydroxybutyl, 6-hydroxyhexyl, 2-aminoethyl, 2-aminopropyl, 3-aminopropyl, 4-aminobutyl, 6-aminohexyl, 2-methylaminoethyl, 2-methylaminopropyl, 3-methylaminopropyl, 4-methylaminobutyl, 6-methylaminohexyl, 2-dimethylaminoethyl, 2-dimethylaminopropyl, 3-dimethylaminopropyl, 4-dimethylaminobutyl, 6-dimethyl-aminohexyl, 2-hydroxy-2,2-dimethylethyl, 2-phenoxyethyl, 2-phenoxypropyl, 3-phenoxypropyl, 4-phenoxybutyl, 6-phenoxyhexyl, 2-methoxyethyl, 2-methoxypropyl, 3-methoxypropyl, 4-methoxybutyl, 6-methoxyhexyl, 2-ethoxyethyl, 2-ethoxypropyl, 3-ethoxypropyl, 4-ethoxybutyl, 6-ethoxyhexyl, acetyl, $C_nF_{2(n-a)+(1-b)}H_{2a+b}$ where n is from 1 to 30, $0 \leqq a \leqq n$ and b=0 or 1 (for example $CF_3$, $C_2F_5$, $CH_2CH_2—C_{(n-2)}F_{2(n-2)+1}$, $C_6F_{13}$, $C_8F_{17}$, $C_{10}F_{21}$, $C_{12}F_{25}$), chloromethyl, 2-chloroethyl, trichloromethyl, 1,1-dimethyl-2-chloroethyl, methoxymethyl, 2-butoxyethyl, diethoxymethyl, diethoxyethyl, 2-iso-propoxyethyl, 2-butoxypropyl, 2-octyloxyethyl, 2-methoxyisopropyl, 2-(methoxycarbonyl)ethyl, 2-(ethoxycarbonyl)ethyl, 2-(n-butoxycarbonyl)ethyl, butylthiomethyl, 2-dodecylthioethyl, 2-phenylthioethyl, 5-hydroxy-3-oxapentyl, 8-hydroxy-3,6-dioxaoctyl, 11-hydroxy-3,6,9-trioxaundecyl, 7-hydroxy-4-oxaheptyl, 11-hydroxy-4,8-dioxaundecyl, 15-hydroxy-4,8,12-trioxapentadecyl, 9-hydroxy-5-oxanonyl, 14-hydroxy-5,10-dioxatetradecyl, 5-methoxy-3-oxapentyl, 8-methoxy-3,6-dioxaoctyl, 11-methoxy-3,6,9-trioxaundecyl, 7-methoxy-4-oxaheptyl, 11-methoxy-4,8-dioxaundecyl, 15-methoxy-4,8,12-trioxapentadecyl, 9-methoxy-5-oxanonyl, 14-methoxy-5,10-dioxatetradecyl, 5-ethoxy-3-oxapentyl, 8-ethoxy-3,6-dioxaoctyl, 11-ethoxy-3,6,9-trioxaundecyl, 7-ethoxy-4-oxaheptyl, 11-ethoxy-4,8-dioxaundecyl, 15-ethoxy-4,8,12-trioxapentadecyl, 9-ethoxy-5-oxanonyl or 14-ethoxy-5,10-oxa-tetradecyl.

$C_2$- to $C_{18}$-Alkenyl optionally substituted by functional groups, aryl, alkyl, aryloxy, alkyloxy, halogen, heteroatoms and/or heterocycles and/or interrupted by one or more oxygen and/or sulfur atoms and/or one or more substituted or unsubstituted imino groups is preferably vinyl, 2-propenyl, 3-butenyl, cis-2-butenyl, trans-2-butenyl or $C_nF_{2(n-a)-(1-b)}H_{2a-b}$ where $n \leqq 30$, $0 \leqq a \leqq n$ and b=0 or 1

$C_6$- to $C_{12}$-Aryl optionally substituted by functional groups, aryl, alkyl, aryloxy, alkyloxy, halogen, heteroatoms and/or heterocycles is preferably phenyl, tolyl, xylyl, α-naphthyl, β-naphthyl, 4-diphenylyl, chlorophenyl, dichlorophenyl, trichlorophenyl, difluorophenyl, methylphenyl, dimethylphenyl, trimethylphenyl, ethylphenyl, diethylphenyl, isopropylphenyl, tert-butylphenyl, dodecylphenyl, methoxyphenyl, dimethoxyphenyl, ethoxyphenyl, hexyloxyphenyl, methylnaphthyl, isopropylnaphthyl, chloronaphthyl, ethoxynaphthyl, 2,6-dimethylphenyl, 2,4,6-trimethylphenyl, 2,6-dimethoxyphenyl, 2,6-dichlorophenyl, 4-bromophenyl, 2-nitrophenyl, 4-nitrophenyl, 2,4-dinitrophenyl, 2,6-dinitrophenyl, 4-dimethylaminophenyl, 4-acetylphenyl, methoxyethylphenyl, ethoxymethylphenyl, methylthiophenyl, isopropylthiophenyl or tert-butylthiophenyl or $C_6F_{(5-a)}H_a$ where $0 \leqq a \leqq 5$.

$C_5$- to $C_{12}$-Cycloalkyl optionally substituted by functional groups, aryl, alkyl, aryloxy, alkyloxy, halogen, heteroatoms and/or heterocycles is preferably cyclopentyl, cyclohexyl, cyclooctyl, cyclododecyl, methylcyclopentyl, dimethylcyclopentyl, methyl-cyclohexyl, dimethylcyclohexyl, diethylcyclohexyl, butylcyclohexyl, methoxycyclohexyl, dimethoxycyclohexyl, diethoxycyclohexyl, butylthiocyclohexyl, chlorocyclohexyl, dichlorocyclohexyl, dichlorocyclopentyl, $C_nF_{2(n-a)-(1-b)}H_{2a-b}$ where $n \leqq 30$, $0 \leqq a \leqq n$ and b=0 or 1, and a saturated or unsaturated bicyclic system, such as, for example, norbornyl or norbornenyl.

$C_5$- to $C_{12}$-Cycloalkenyl optionally substituted by functional groups, aryl, alkyl, aryloxy, alkyloxy, halogen, heteroatoms and/or heterocycles is preferably 3-cyclopentenyl, 2-cyclohexenyl, 3-cyclohexenyl, 2,5-cyclohexadienyl or $C_nF_{2(n-a)-3(1-b)}H_{2a-3b}$ where $n \leqq 30$, $0 \leqq a \leqq n$ and b=0 or 1.

A five- to six-membered heterocycle optionally substituted by functional groups, aryl, alkyl, aryloxy, alkyloxy, halogen, heteroatoms and/or heterocycles and having oxygen, nitrogen and/or sulfur atoms is preferably furyl, thiophenyl, pyrryl, pyridyl, indolyl, benzoxazolyl, dioxolyl, dioxyl, benzimidazolyl, benzthiazolyl, dimethylpyridyl, methylquinolyl, dimethylpyrryl, methoxyfuryl, dimethoxypyridyl or difluoropyridyl.

If two neighboring radicals together form an unsaturated, saturated or aromatic ring optionally substituted by functional groups, aryl, alkyl, aryloxy, alkyloxy, halogen, heteroatoms and/or heterocycles and optionally interrupted by one or more oxygen and/or sulfur atoms and/or one or more substituted or unsubstituted imino groups, it is preferably 1,3-propylene, 1,4-butylene, 1,5-pentylene, 2-oxa-1,3-propylene, 1-oxa-1,3-propylene, 2-oxa-1,3-propylene, 1-oxa-1,3-propenylene, 3-oxa-1,5-pentylene, 1-aza-1,3-propenylene, 1-$C_1$-$C_4$-alkyl-1-aza-1,3-propenylene, 1,4-buta-1,3-dienylene, 1-aza-1,4-buta-1,3-dienylene or 2-aza-1,4-buta-1,3-dienylene.

If the abovementioned radicals comprise oxygen and/or sulfur atoms and/or substituted or unsubstituted imino groups, the number of oxygen atoms and/or sulfur atoms and/or imino groups is not limited. As a rule, it is not more than 5 in the radical, preferably not more than 4 and very particularly preferably not more than 3.

If the abovementioned radicals comprise heteroatoms, as a rule at least one carbon atom, preferably at least two carbon atoms, is or are present between two heteroatoms.

The radicals $R^1$ to $R^9$, independently of one another, are particularly preferably hydrogen;

straight-chain or branched, $C_1$- to $C_{18}$-alkyl which is unsubstituted or monosubstituted to polysubstituted by hydroxyl, halogen, phenyl, cyano, $C_1$- to $C_6$-alkoxycarbonyl and/or sulfo and has altogether 1 to 20 carbon atoms, such as, for example, methyl, ethyl, 1-propyl, 2-propyl, 1-butyl, 2-butyl, 2-methyl-1-propyl (isobutyl), 2-methyl-2-propyl (tert-butyl), 1-pentyl, 2-pentyl, 3-pentyl, 2-methyl-1-butyl, 3-methyl-1-butyl, 2-methyl-2-butyl, 3-methyl-2-butyl, 2,2-dimethyl-1-propyl, 1-hexyl, 2-hexyl, 3-hexyl, 2-methyl-1-pentyl, 3-methyl-1-pentyl, 4-methyl-1-pentyl, 2-methyl-2-pentyl, 3-methyl-2-pentyl, 4-methyl-2-pentyl, 2-methyl-3-pentyl, 3-methyl-3-pentyl, 2,2-dimethyl-1-butyl, 2,3-dimethyl-1-butyl, 3,3-dimethyl-1-butyl, 2-ethyl-1-butyl, 2,3-dimethyl-2-butyl, 3,3-dimethyl-2-butyl, 1-heptyl, 1-octyl, 1-nonyl, 1-decyl, 1-undecyl, 1-dodecyl, 1-tetradecyl, 1-hexadecyl, 1-octadecyl, 2-hydroxyethyl, benzyl, 3-phenylpropyl, 2-cyanoethyl, 2-(methoxycarbonyl) ethyl, 2-(ethoxycarbonyl)ethyl, 2-(n-butoxycarbonyl) ethyl, trifluoromethyl, difluoromethyl, fluoromethyl, pentafluoroethyl, heptafluoropropyl, heptafluoroisopropyl, nonafluorobutyl, nonafluoroisobutyl, undecylfluoropentyl, undecylfluoroisopentyl, 6-hydroxyhexyl and propylsulfonic acid;

glycols, butylene glycols and oligomers thereof having 1 to 100 units and one hydrogen or one $C_1$- to $C_8$-alkyl as a terminal group, such as, for example, $R^AO—(CHR^B—CH_2—O)_n—CHR^B—CH_2—$ or $R^AO—(CH_2CH_2CH_2CH_2O)_n—CH_2CH_2CH_2CH_2O—$ where $R^A$ and $R^B$ are preferably hydrogen, methyl or ethyl and n is preferably from 0 to 3, in particular 3-oxabutyl, 3-oxapentyl, 3,6-dioxa-heptyl, 3,6-dioxaoctyl, 3,6,9-trioxadecyl, 3,6,9-trioxaundecyl, 3,6,9,12-tetraoxa-tridecyl and 3,6,9,12-tetraoxatetradecyl;

vinyl; and

N,N-di-$C_1$ to $C_6$-alkylamino, such as, for example, N,N-dimethylamino and N,N-diethylamino.

The radicals $R^1$ to $R^9$, independently of one another, are very particularly preferably hydrogen or $C_1$- to $C_{18}$-alkyl, such as, for example, methyl, ethyl, 1-butyl, 1-pentyl, 1-hexyl, 1-heptyl or 1-octyl, phenyl, 2-hydroxyethyl, 2-cyanoethyl, 2-(methoxycarbonyl)ethyl, 2-(ethoxycarbonyl)ethyl, 2-(n-butoxycarbonyl)ethyl, N,N-dimethylamino, N,N-diethylamino, chlorine and $CH_3O—(CH_2CH_2O)_n—CH_2CH_2—$ and $CH_3CH_2O—(CH_2CH_2O)_n—CH_2CH_2—$ where n is from 0 to 3.

Very particularly preferably used pyridinium ions (IVa) are those in which one of the radicals $R^1$ to $R^5$ is methyl, ethyl or chlorine and the remaining radicals $R^1$ to $R^5$ are hydrogen;

$R^3$ is dimethylamino and the remaining radicals $R^1$, $R^2$, $R^4$ and $R^5$ are hydrogen;

all radicals $R^1$ to $R^5$ are hydrogen;

$R^2$ is carboxyl or carboxamido and the remaining radicals $R^1$, $R^2$, $R^4$ and $R^5$ are hydrogen; or $R^1$ and $R^2$ or $R^2$ and $R^3$ are 1,4-buta-1,3-dienylene and the remaining radicals $R^1$, $R^2$, $R^4$ and $R^5$ are hydrogen;

and in particular those in which $R^1$ to $R^5$ are hydrogen; or one of the radicals $R^1$ to $R^5$ is methyl or ethyl and the remaining radicals $R^1$ to $R^5$ are hydrogen.

1-Methylpyridinium, 1-ethylpyridinium, 1-(1-butyl)pyridinium, 1-(1-hexyl)pyridinium, 1-(1-octyl)pyridinium, 1-(1-hexyl)pyridinium, 1-(1-octyl)pyridinium, 1-(1-dodecyl)-pyridinium, 1-(1-tetradecyl)pyridinium, 1-(1-hexadecyl) pyridinium, 1,2-dimethyl-pyridinium, 1-ethyl-2-methylpyridinium, 1-(1-butyl)-2-methylpyridinium, 1-(1-hexyl)-2-methylpyridinium, 1-(1-octyl)-2-methylpyridinium, 1-(1-dodecyl)-2-methylpyridinium, 1-(1-tetradecyl)-2-methylpyridinium, 1-(1-hexadecyl)-2-methylpyridinium, 1-methyl-2-ethylpyridinium, 1,2-diethylpyridinium, 1-(1-butyl)-2-ethylpyridinium, 1-(1-hexyl)-2-ethylpyridinium, 1-(1-octyl)-2-ethylpyridinium, 1-(1-dodecyl)-2-ethylpyridinium, 1-(1-tetradecyl)-2-ethylpyridinium, 1-(1-hexadecyl)-2-ethylpyridinium, 1,2-dimethyl-5-ethylpyridinium, 1,5-diethyl-2-methylpyridinium, 1-(1-butyl)-2-methyl-3-ethylpyridinium, 1-(1-hexyl)-2-methyl-3-ethylpyridinium and 1-(1-octyl)-2-methyl-3-ethylpyridinium, 1-(1-dodecyl)-2-methyl-3-ethylpyridinium, 1-(1-tetradecyl)-2-methyl-3-ethylpyridinium and 1-(1-hexadecyl)-2-methyl-3-ethylpyridinium may be mentioned as very particularly preferred pyridinium ions (IVa).

Very particularly preferably used pyridazinium ions (IVb) are those in which $R^1$ to $R^4$ are hydrogen; or one of the radicals $R^1$ to $R^4$ is methyl or ethyl and the remaining radicals $R^1$ to $R^4$ are hydrogen.

Very particularly preferably used pyrimidinium ions (IVc) are those in which $R^1$ is hydrogen, methyl or ethyl and $R^2$ to $R^4$, independently of one another, are hydrogen or methyl; or $R^1$ is hydrogen, methyl or ethyl, $R^2$ and $R^4$ are methyl and $R^3$ is hydrogen.

Very particularly preferably used pyrazinium ions (IVd) are those in which $R^1$ is hydrogen, methyl or ethyl and $R^2$ to $R^4$, independently of one another, are hydrogen or methyl;

$R^1$ is hydrogen, methyl or ethyl, $R^2$ and $R^4$ are methyl and $R^3$ is hydrogen;

$R^1$ to $R^4$ are methyl; or $R^1$ to $R^4$ are methyl or hydrogen.

Very particularly preferably used imidazolium ions (IVe) are those in which $R^1$ is hydrogen, methyl, ethyl, 1-propyl, 1-butyl, 1-pentyl, 1-hexyl, 1-octyl, 2-hydroxyethyl or 2-cyanoethyl and $R^2$ to $R^4$, independently of one another, are hydrogen, methyl or ethyl.

1-Methylimidazolium, 1-ethylimidazolium, 1-(1-butyl) imidazolium, 1-(1-octyl)-imidazolium, 1-(1-dodecyl)imidazolium, 1-(1-tetradecyl)imidazolium, 1-(1-hexadecyl)-imidazolium, 1,3-dimethylimidazolium, 1-ethyl-3-methylimidazolium, 1-(1-butyl)-3-methylimidazolium, 1-(1-butyl)-3-ethylimidazolium, 1-(1-hexyl)-3-methylimidazolium, 1-(1-hexyl)-3-ethylimidazolium, 5-(1-hexyl)-3-butylimidazolium, 1-(1-octyl)-3-methyl-imidazolium, 1-(1-octyl)-3-ethylimidazolium, 1-(1-octyl)-3-butylimidazolium, 1-(1-dodecyl)-3-methylimidazolium, 1-(1-dodecyl)-3-ethylimidazolium, 1-(1-dodecyl)-3-butyl-imidazolium, 1-(1-dodecyl)-3-octylimidazolium, 1-(1-tetradecyl)-3-methyl-imidazolium, 1-(1-tetradecyl)-3-ethylimidazolium, 1-(1-tetradecyl)-3-butylimidazolium, 1-(1-tetradecyl)-3-octylimidazolium, 1-(1-hexadecyl)-3-methylimidazolium, 1-(1-hexadecyl)-3-ethylimidazolium, 1-(1-hexadecyl)-3-butylimidazolium, 1-(1-hexa-decyl)-3-octylimidazolium, 1,2-dimethylimidazolium, 1,2,3-trimethylimidazolium, 1-ethyl-2,3-dimethylimidazolium, 1-(1-butyl)-2,3-dimethylimidazolium, 1-(1-hexyl)-2,3-dimethyl-imidazolium, 1-(1-octyl)-2,3-dimethylimidazolium, 1,4-dimethylimidazolium, 1,3,4-trimethylimidazolium, 1,4-dimethyl-3-ethylimidazolium, 3-butylimidazolium, 1,4-dimethyl-3-octylimidazolium, 1,4,5-trimethyl imidazolium, 1,3,4,5-tetramethyl-imidazolium, 1,4,5-trimethyl-3-ethylimidazolium, 1,4,5-trimethyl-3-butylimidazolium and 1,4,5-trimethyl-3-octylimidazolium may be mentioned as very particularly preferred imidazolium ions (IVe).

Very particularly preferably used pyrazolium ions (IVf), (IVg) or (IVg') are those in which $R^1$ is hydrogen, methyl or ethyl and $R^2$ to $R^4$, independently of one another, are hydrogen or methyl.

Very particularly preferably used pyrazolium ions (IVh) are those in which $R^1$ to $R^4$, independently of one another, are hydrogen or methyl.

Very particularly preferably used 1-pyrazolinium ions (IVi) are those in which $R^1$ to $R^6$, independently of one another, are hydrogen or methyl.

Very particularly preferably used 2-pyrazolinium ions (IVj) or (IVj') are those in which $R^1$ is hydrogen, methyl, ethyl or phenyl and $R^2$ to $R^6$, independently of one another, are hydrogen or methyl.

Very particularly preferably used 3-pyrazolinium ions (IVk) or (IVk') are those in which $R^1$ and $R^2$, independently of one another, are hydrogen, methyl, ethyl or phenyl and $R^3$ to $R^6$, independently of one another, are hydrogen or methyl.

Very particularly preferably used imidazolinium ions (IVl) are those in which $R^1$ and $R^{22}$ independently of one another, are hydrogen, methyl, ethyl, 1-butyl or phenyl, $R^3$ and $R^4$, independently of one another, are hydrogen, methyl or ethyl and $R^5$ and $R^6$, independently of one another, are hydrogen or methyl.

Very particularly preferably used imidazolinium ions (IVm) or (IVm') are those in which $R^1$ and $R^2$, independently of one another, are hydrogen, methyl or ethyl and $R^3$ to $R^6$, independently of one another, are hydrogen or methyl.

Very particularly preferably used imidazolinium ions (IVn) or (IVn') are those in which $R^1$ to $R^3$, independently of one another, are hydrogen, methyl or ethyl and $R^4$ to $R^6$, independently of one another, are hydrogen or methyl.

Very particularly preferably used thiazolium ions (IVo) or (IVo') and very particularly preferably used oxazolium ions (IVp) are those in which $R^1$ is hydrogen, methyl, ethyl or phenyl and $R^2$ and $R^3$, independently of one another, are hydrogen or methyl.

Very particularly preferably used 1,2,4-triazolium ions (IVq), (IVq') or (IVq") are those in which $R^1$ and $R^2$, independently of one another, are hydrogen, methyl, ethyl or phenyl and $R^3$ is hydrogen methyl or phenyl.

Very particularly preferably used 1,2,3-triazolium ions (IVr), (IVr') or (IVr") are those in which $R^1$ is hydrogen methyl or ethyl and $R^2$ and $R^3$, independently of one another, are hydrogen or methyl, or $R^2$ and $R^3$ together are 1,4-buta-1,3-dienylene.

Very particularly preferably used pyrrolidinium ions (IVs) are those in which $R^1$ is hydrogen, methyl, ethyl or phenyl and $R^2$ to $R^9$, independently of one another, are hydrogen or methyl.

Very particularly preferably used imidazolidinium ions (IVt) are those in which $R^1$ and $R^4$, independently of one another, are hydrogen, methyl, ethyl or phenyl and $R^2$ and $R^3$, and $R^5$ to $R^8$, independently of one another, are hydrogen or methyl.

Very particularly preferably used ammonium ions (IVu) are those in which $R^1$ to $R^3$, independently of one another, are $C_1$- to $C_{18}$-alkyl; or $R^1$ and $R^2$ together are 1,5-pentylene or 3-oxa-1,5-pentylene and $R^3$ is $C_1$-$C_{18}$-alkyl, 2-hydroxyethyl or 2-cyanoethyl.

Methyltri(1-butyl)ammonium, N,N-dimethylpiperidinium and N,N-dimethylmorpholinium may be mentioned as very particularly preferred ammonium ions (IVu).

Examples of the tertiary amines from which the quaternary ammonium ions of the general formula (IVu) are derived by quaternization with said radicals R are diethyl-n-butylamine, diethyl-tert-butylamine, diethyl-n-pentylamine, diethylhexylamine, diethyl-octylamine, diethyl-(2-ethylhexyl)amine, di-n-propylbutylamine, di-n-propyl-n-pentyl-amine, di-n-propylhexylamine, di-n-propyloctylamine, di-n-propyl-(2-ethylhexyl)amine, diisopropylethylamine, diisopropyl-n-propylamine, diisopropylbutylamine, diisopropylpentylamine, diisopropylhexylamine, diisopropyloctylamine, diisopropyl-(2-ethylhexyl)amine, di-n-butylethylamine, di-n-butyl-n-propylamine, di-n-butyl-n-pentyl-amine, di-n-butylhexylamine, di-n-butyloctylamine, di-n-butyl-(2-ethylhexyl)amine, N-n-butylpyrrolidine, N-sec-butylpyrrolidine, N-tert-butylpyrrolidine, N-n-pentylpyrrolidine, N,N-dimethylcyclohexylamine, N,N-diethylcyclohexylamine, N,N-di-n-butyl-cyclohexylamine, N-n-propylpiperidine, N-isopropylpiperidine, N-n-butylpiperidine, N-sec-butylpiperidine, N-tert-butylpiperidine, N-n-pentylpiperidine, N-n-butylmorpholine, N-sec-butylmorpholine, N-tert-butylmorpholine, N-n-pentylmorpholine, N-benzyl-N-ethylaniline, N-benzyl-N-n-propylaniline, N-benzyl-N-isopropylaniline, N-benzyl-N-n-butylaniline, N,N-dimethyl-p-toluidine, N,N-diethyl-p-toluidine, N,N-di-n-butyl-p-toluidine, diethylbenzylamine, di-n-propylbenzylamine, di-n-butylbenzylamine, diethyl-phenylamine, di-n-propylphenylamine and di-n-butylphenylamine.

Preferred tertiary amines (IVu) are diisopropylethylamine, diethyl-tert-butylamine, diisopropylbutylamine, di-n-butyl-n-pentylamine, N,N-di-n-butylcyclohexylamine and tertiary amines obtained from pentyl isomers.

Particularly preferred tertiary amines are di-n-butyl-n-pentylamine and tertiary amines obtained from pentyl isomers. A further preferred tertiary amine which has three identical radicals is triallylamine.

Very particularly preferably used guanidinium ions (IVv) are those in which $R^1$ to $R^5$ are methyl.

N,N,N',N',N",N"-Hexamethylguanidinium may be mentioned as a very particularly preferred guanidinium ion (IVv).

Very particularly preferably used cholinium ions (IVw) are those in which $R^1$ and $R^2$, independently of one another, are methyl, ethyl, 1-butyl or 1-octyl and $R^3$ is hydrogen, methyl, ethyl, acetyl, —$SO_2OH$ or —$PO(OH)_2$;

$R^1$ is methyl, ethyl, 1-butyl or 1-octyl, $R^2$ is a —$CH_2$—$CH_2$—$OR^4$ group and $R^3$ and $R^4$, independently of one another, are hydrogen, methyl, ethyl, acetyl, —$SO_2OH$ or —$PO(OH)_2$; or $R^1$ is a —$CH_2$—$CH_2$—$OR^4$ group, $R^2$ is a —$CH_2$—$CH_2$—$OR^5$ group and $R^3$ to $R^5$, independently of one another, are hydrogen, methyl, ethyl, acetyl, —$SO_2OH$ or —$PO(OH)_2$.

Particularly preferred cholinium ions (IVw) are those in which $R^3$ is selected from hydrogen, methyl, ethyl, acetyl, 5-methoxy-3-oxapentyl, 8-methoxy-3,6-dioxaoctyl, 11-methoxy-3,6,9-trioxaundecyl, 7-methoxy-4-oxaheptyl, 11-methoxy-4,8-dioxa-undecyl, 15-methoxy-4,8,12-trioxapentadecyl, 9-methoxy-5-oxanonyl, 14-methoxy-5,10-oxatetradecyl, 5-ethoxy-3-oxapentyl, 8-ethoxy-3,6-dioxaoctyl, 11-ethoxy-3,6,9-trioxaundecyl, 7-ethoxy-4-oxaheptyl, 11-ethoxy-4,8-dioxaundecyl, 15-ethoxy-4,8,12-trioxapentadecyl, 9-ethoxy-5-oxanonyl or 14-ethoxy-5,10-oxatetradecyl.

Very particularly preferably used phosphonium ions (IVx) are those in which $R^1$ to $R^3$, independently of one another, are $C_1$-$C_{18}$-alkyl, in particular butyl, isobutyl, 1-hexyl or 1-octyl.

Among the abovementioned heterocyclic cations, the pyridinium ions, pyrazolinium ions, pyrazolium ions and the imidazolinium ions and the imidazolium ions are preferred. Ammonium ions are furthermore preferred.

Particularly preferred are 1-methylpyridinium, 1-ethylpyridinium, 1-(1-butyl)pyridinium, 1-(1-hexyl)pyridinium, 1-(1-octyl)pyridinium, 1-(1-hexyl)pyridinium, 1-(1-octyl)-pyridinium, 1-(1-dodecyl)pyridinium, 1-(1-tetradecyl)pyridinium, 1-(1-hexadecyl)-pyridinium, 1,2-dimethylpyridinium, 1-ethyl-2-methylpyridinium, 1-(1-butyl)-2-methylpyridinium, 1-(1-hexyl)-2-methylpyridinium, 1-(1-octyl)-2-methylpyridinium, 1-(1-dodecyl)-2-methylpyridinium, 1-(1-tetradecyl)-2-methylpyridinium, 1-(1-hexadecyl)-2-methylpyridinium, 1-methyl-2-ethylpyridinium, 1,2-diethylpyridinium, 1-(1-butyl)-2-ethylpyridinium, 1-(1-hexyl)-2-ethylpyridinium, 1-(1-octyl)-2-ethylpyridinium, 1-(1-dodecyl)-2-ethylpyridinium, 1-(1-tetradecyl)-2-ethylpyridinium, 1-(1-hexadecyl)-2-ethylpyridinium, 1,2-dimethyl-5-ethylpyridinium, 1,5-diethyl-2-methylpyridinium, 1-(1-butyl)-2-methyl-3-ethylpyridinium, 1-(1-hexyl)-2-methyl-3-ethylpyridinium, 1-(1-octyl)-2-methyl-3-ethylpyridinium, 1-(1-dodecyl)-2-methyl-3-ethylpyridinium, 1-(1-tetradecyl)-2-methyl-3-ethylpyridinium, 1-(1-hexadecyl)-2-methyl-3-ethylpyridinium, 1-methylimidazolium, 1-ethylimidazolium, 1-(1-butyl)imidazolium, 1-(1-octyl)imidazolium, 1-(1-dodecyl)imidazolium, 1-(1-tetradecyl)imidazolium, 1-(1-hexadecyl)imidazolium, 1,3-dimethylimidazolium, 1-ethyl-3-methylimidazolium, 1-(1-butyl)-3-methylimidazolium, 1-(1-hexyl)-3-methylimidazolium, 1-(1-octyl)-3-methylimidazolium, 1-(1-dodecyl)-3-methylimidazolium, 1-(1-tetradecyl)-3-methylimidazolium, 1-(1-hexadecyl)-3-methyl-imidazolium, 1,2-dimethylimidazolium, 1,2,3-trimethylimidazolium, 1-ethyl-2,3-dimethylimidazolium, 1-(1-butyl)-2,3-dimethylimidazolium, 1-(1-hexyl)-2,3-dimethylimidazolium and 1-(1-octyl)-2,3-dimethylimidazolium, 1,4-dimethylimidazolium, 1,3,4-trimethylimidazolium, 1,4-dimethyl-3-ethylimidazolium, 3-butylimidazolium, 1,4-dimethyl-3-octylimidazolium, 1,4,5-trimethylimidazolium, 1,3,4,5-tetramethylimidazolium, 1,4,5-trimethyl-3-ethylimidazolium, 1,4,5-trimethyl-3-butylimidazolium and 1,4,5-trimethyl-3-octylimidazolium.

The metal cations $[M^1]^+$, $[M^2]^+$, $[M^3]^+$, $[M^4]^{2+}$ and $[M^5]^{3+}$ stated in the formulae (IIIa) to (IIIj) are in general metal cations of the 1st, 2nd, 6th, 7th, 8th, 9th, 10th, 11th, 12th and 13th group of the Periodic Table of the Elements. Suitable metal cations are, for example, $Li^+$, $Na^+$, $K^+$, $Cs^+$, $Mg^{2+}$, $Ca^{2+}$, $Ba^{2+}$, $Cr^{3+}$, $Fe^{2+}$, $Fe^{3+}$, $Co^{2+}$, $Ni^{2+}$, $Cu^{2+}$, $Ag^+$, $Zn^{2+}$ and $Al^{3+}$.

Anions which may be used are in principle any anions.

The anion $[Y]^{n-}$ of the ionic liquid is selected, for example, from the group consisting of the halides, the halogen-containing compounds and the pseudohalides of the formula:

$F^-$, $Cl^-$, $Br^-$, $I^-$, $BF_4^-$, $PF_6^-$, $AlCl_4^-$, $Al_2Cl_7^-$, $Al_3Cl_{10}^-$, $AlBr_4^-$, $FeCl_4^-$, $BCl_4^-$, $SbF_6^-$, $AsF_6^-$, $ZnCl_3^-$, $SnCl_3^-$, $CuCl_2^-$, $CF_3SO_3^-$, $(CF_3SO_3)_2N^-$, $CF_3CO_2^-$, $CCl_3CO_2^-$, $CN^-$, $SCN^-$, $OCN^-$ the group consisting of the sulfates, sulfites and sulfonates of the general formula:

$SO_4^{2-}$, $HSO_4^-$, $SO_3^{2-}$, $HSO_3^-$, $R^aOSO_3^-$, $R^aSO_3^-$;

the group consisting of the phosphates of the general formula:

$PO_4^{3-}$, $HPO_4^{2-}$, $H_2PO_4^-$, $R^aPO_4^{2-}$, $HR^aPO_4^-$, $R^aR^bPO_4^-$ the group consisting of the phosphonates and phosphinates of the general formula:

$R^aHPO_3^-$, $R^aR^bPO_2^-$, $R^aR^bPO_3^-$ the group consisting of the phosphites of the general formula:

$PO_3^{3-}$, $HPO_3^{2-}$, $H_2PO_3^-$, $R^aPO_3^{2-}$, $R^aHPO_3^-$, $R^aR^bPO_3^-$ the group consisting of the phosphonites and phosphinites of the general formula:

$R^aR^bPO_2^-$, $R^aHPO_2^-$, $R^aR^bPO^-$, $R^aHPO^-$ the group consisting of the carboxylic acids of the general formula:

$R^aCOO^-$ the group consisting of the borates of the general formula:

$BO_3^{3-}$, $HBO_3^{2-}$, $H_2BO_3^-$, $R^aR^bBO_3^-$, $R^aHBO_3^-$, $R^aBO_3^{2-}$, $B(OR^a)(OR^b)(OR^c)(OR^d)^-$, $B(HSO_4)^-$, $B(R^aSO4)^-$ the group consisting of the boronates of the general formula:

$R^aBO_2^{2-}$, $R^aR^bBO^-$ the group consisting of the carbonates and carbonic acid esters of the general formula:

$HCO_3^-$, $CO_3^{2-}$, $R^aCO_3^-$ the group consisting of the silicates and silicic acid esters of the general formula:

$SiO_4^{4-}$, $HSiO_4^{3-}$, $H_2SiO_4^-$, $H_3SiO_4^-$, $R^aSiO_4^{3-}$, $R^aR^bSiO_4^{2-}$, $R^aR^bR^cSiO_4^-$, $HR^aSiO_4^{2-}$, $H_2R^aSiO_4^-$, $HR^aR^bSiO_4^-$ the group consisting of the alkyl- or arylsilane salts of the general formula:

$R^aSiO_3^{3-}$, $R^aR^bSiO_2^{2-}$, $R^aR^bR^cSiO^-$, $R^aR^bR^cSiO_3^-$, $R^aR^bR^cSiO_2^-$, $R^aR^bSiO_3^{2-}$ the group consisting of the carboximides, bis(sulfonyl) imides, sulfonylimides and dicyanamides of the general formula:

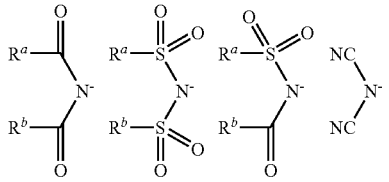

the group consisting of the methides of the general formula:

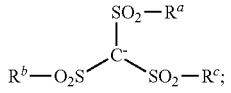

a the group consisting of the alkoxides and aryl oxides of the general formulae:

$R^aO^-$;

the group consisting of the halometallates of the general formula:

$[M_qHal_r]^{s-}$, where M is a metal and Hal is fluorine, chlorine, bromine or iodine, q and r are positive integers and indicate the stoichiometry of the complex and s is a positive integer and indicates the charge of the complex;

the group consisting of the sulfides, hydrogen sulfides, polysulfides, hydrogen polysulfides and thiolates of the general formulae:

$S^{2-}$, $HS^-$, $[S_v]_{2-}$, $[HS_v]^-$, $[R^aS]^-$, where v is a positive integer from 2 to 10;

the group consisting of the complex metal ions, such as $Fe(CN)_6^{3-}$, $Fe(CN)_6^{4-}$, $MnO_4^-$, $Fe(CO)_4^-$.

There, $R^a$, $R^b$, $R^c$ and $R^d$, independently of one another, are each hydrogen, $C_1$-$C_{30}$-alkyl, $C_2$-$C_{18}$-alkyl optionally interrupted by one or more nonneighboring oxygen and/or sulfur atoms and/or one or more substituted or unsubstituted imino groups, $C_6$-$C_{14}$-aryl, $C_5$-$C_{12}$-cycloalkyl or a five- or six-membered heterocycle having oxygen, nitrogen and/or sulfur atoms, it being possible for two of them together to form an unsaturated, saturated or aromatic ring optionally interrupted by one or more oxygen and/or sulfur atoms and/or one or more unsubstituted or substituted imino groups, it being possible for said radicals in each case additionally to be substituted by functional groups, aryl, alkyl, aryloxy, alkoxy, halogen, heteroatoms and/or heterocycles.

There, $C_1$-$C_{18}$-alkyl optionally substituted by functional groups, aryl, alkyl, aryloxy, alkyloxy, halogen, heteroatoms and/or heterocycles is, for example, methyl, ethyl, propyl, isopropyl, n-butyl, sec-butyl, tert-butyl, pentyl, hexyl, heptyl, octyl, 2-ethylhexyl, 2,4,4-trimethylpentyl, decyl, dodecyl, tetradecyl, hexadecyl, octadecyl, 1,1-dimethylpropyl, 1,1-dimethylbutyl, 1,1,3,3-tetramethylbutyl, benzyl, 1-phenylethyl, α,α-dimethylbenzyl, benzhydryl, p-tolylmethyl, 1-(p-butylphenyl)ethyl, p-chlorobenzyl, 2,4-dichlorobenzyl, p-methoxybenzyl, m-ethoxybenzyl, 2-cyanoethyl, 2-cyanopropyl, 2-methoxycarbonylethyl, 2-ethoxycarbonylethyl, 2-butoxycarbonylpropyl, 1,2-di-(methoxycarbonyl)ethyl, 2-methoxyethyl, 2-ethoxyethyl, 2-butoxyethyl, diethoxymethyl, diethoxyethyl, 1,3-dioxolan-2-yl, 1,3-dioxan-2-yl, 2-methyl-1,3-dioxolan-2-yl, 4-methyl-1,3-dioxolan-2-yl, 2-isopropoxyethyl, 2-butoxypropyl, 2-octyloxyethyl, chloromethyl, trichloromethyl, trifluoromethyl, 1,1-dimethyl-2-chloroethyl, 2-methoxyisopropyl, 2-ethoxyethyl, butylthiomethyl, 2-dodecylthioethyl, 2-phenylthioethyl, 2,2,2-trifluoroethyl, 2-hydroxyethyl, 2-hydroxypropyl, 3-hydroxypropyl, 4-hydroxybutyl, 6-hydroxyhexyl, 2-aminoethyl, 2-aminopropyl, 4-aminobutyl, 6-aminohexyl, 2-methyl-aminoethyl, 2-methylaminopropyl, 3-methylaminopropyl, 4-methylaminobutyl, 6-methyl-aminohexyl, 2-dimethylaminoethyl, 2-dimethylaminopropyl, 3-dimethylaminopropyl, 4-dimethylaminobutyl, 6-dimethylaminohexyl, 2-hydroxy-2,2-dimethylethyl, 2-phenoxy-ethyl, 2-phenoxypropyl, 3-phenoxypropyl, 4-phenoxybutyl, 6-phenoxyhexyl, 2-methoxyethyl, 2-methoxypropyl, 3-methoxypropyl, 4-methoxybutyl, 6-methoxyhexyl, 2-ethoxyethyl, 2-ethoxypropyl, 3-ethoxypropyl, 4-ethoxybutyl or 6-ethoxyhexyl.

$C_2$-$C_{18}$-Alkyl optionally interrupted by one or more nonneighboring oxygen and/or sulfur atoms and/or one or more substituted or unsubstituted imino groups is, for example, 5-hydroxy-3-oxapentyl, 8-hydroxy-3,6-dioxaoctyl, 11-hydroxy-3,6,9-trioxaundecyl, 7-hydroxy-4-oxaheptyl, 11-hydroxy-4,8-dioxaundecyl, 15-hydroxy-4,8,12-trioxa-pentadecyl, 9-hydroxy-5-oxanonyl, 14-hydroxy-5,10-oxatetradecyl, 5-methoxy-3-oxapentyl, 8-methoxy-3,6-dioxaoctyl, 11-methoxy-3,6,9-trioxaundecyl, 7-methoxy-4-oxaheptyl, 11-methoxy-4,8-dioxaundecyl, 15-methoxy-4,8,12-trioxapentadecyl, 9-methoxy-5-oxanonyl, 14-methoxy-5,10-oxatetradecyl, 5-ethoxy-3-oxapentyl, 8-ethoxy-3,6-dioxaoctyl, 11-ethoxy-3,6,9-trioxaundecyl, 7-ethoxy-4-oxaheptyl, 11-ethoxy-4,8-dioxaundecyl, 15-ethoxy-4,8,12-trioxapentadecyl, 9-ethoxy-5-oxanonyl or 14-ethoxy-5,10-oxatetradecyl.

If two radicals form a ring, these radicals together, for example as a fused building block, may be 1,3-propylene, 1,4-butylene, 2-oxa-1,3-propylene, 1-oxa-1,3-propylene, 2-oxa-1,3-propenylene, 1-aza-1,3-propenylene, 1-$C_1$-$C_4$-alkyl-1-aza-1,3-propenylene, 1,4-buta-1,3-dienylene, 1-aza-1,4-buta-1,3-dienylene or 2-aza-1,4-buta-1,3-dienylene.

The number of nonneighboring oxygen and/or sulfur atoms and/or imino groups is in principle not limited or is automatically limited by the size of the radical or of the ring building block. As a rule, it is not more than 5 in the respective radical, preferably not more than 4 or very particularly preferably not more than 3. Furthermore, as a rule at least one, preferably at least two, carbon atom(s) is or are present between two heteroatoms.

Substituted and unsubstituted imino groups may be, for example, imino, methylimino, isopropylimino, n-butylimino or tert-butylimino.

The term "functional groups" is to be understood as meaning, for example, the following: carboxyl, carboxamido, hydroxyl, di($C_1$-$C_4$-alkyl)amino, $C_1$-$C_4$-alkyloxycarbonyl, cyano or $C_1$-$C_4$-alkoxy. $C_1$ to $C_4$-Alkyl is methyl, ethyl, propyl, isopropyl, n-butyl, sec-butyl or tert-butyl.

$C_6$-$C_{14}$-Aryl optionally substituted by functional groups, aryl, alkyl, aryloxy, alkyloxy, halogen, heteroatoms and/or heterocycles is, for example, phenyl, tolyl, xylyl, α-naphthyl, β-naphthyl, 4-diphenylyl, chlorophenyl, dichlorophenyl, trichlorophenyl, difluorophenyl, methylphenyl, dimethylphenyl, trimethylphenyl, ethylphenyl, diethylphenyl, isopropylphenyl, tert-butylphenyl, dodecylphenyl, methoxyphenyl, dimethoxyphenyl, ethoxyphenyl, hexyloxyphenyl, methylnaphthyl, isopropylnaphthyl, chloronaphthyl, ethoxynaphthyl, 2,6-dimethylphenyl, 2,4,6-trimethylphenyl, 2,6-dimethoxyphenyl, 2,6-dichlorophenyl, 4-bromophenyl, 2- or 4-nitrophenyl, 2,4- or 2,6-dinitrophenyl, 4-dimethylaminophenyl, 4-acetylphenyl, methoxyethylphenyl or ethoxymethylphenyl.

$C_5$-$C_{12}$-Cycloalkyl optionally substituted by functional groups, aryl, alkyl, aryloxy, halogen, heteroatoms and/or heterocycles is, for example, cyclopentyl, cyclohexyl, cyclooctyl, cyclododecyl, methylcyclopentyl, dimethylcyclopentyl, methylcyclohexyl, dimethylcyclohexyl, diethylcyclohexyl, butylcyclohexyl, methoxycyclohexyl, dimethoxycyclohexyl, diethoxycyclohexyl, butylthiocyclohexyl, chlorocyclohexyl, dichlorocyclohexyl, dichlorocyclopentyl and a saturated or unsaturated bicyclic system, such as norbornyl or norbornenyl.

A five- or six-membered heterocycle having oxygen, nitrogen and/or sulfur atoms is, for example, furyl, thiophenyl, pyrryl, pyridyl, indolyl, benzoxazolyl, dioxolyl, dioxyl, benzimidazolyl, benzthiazolyl, dimethylpyridyl, methylquinolyl, dimethylpyrryl, methoxyfuryl, dimethoxypyridyl, difluoropyridyl, methylthiophenyl, isopropylthiophenyl or tert-butylthiophenyl.

Preferred anions are selected from the group consisting of the halides, halogen-containing compounds and pseudohalides, from the group consisting of the dicyanamides, from the group consisting of the carboxylic acids, from the group consisting of the sulfates, sulfites and sulfonates and from the group consisting of the phosphates.

Preferred anions are chloride, bromide, iodide, $SCN^-$, $OCN^-$, $CN^-$, $N(CN)_2^-$, acetate, $C_1$-$C_4$ alkylsulfates, $R^a$—$COO^-$, $R^aSO_3^-$, $R^aR^bPO_4^-$, methanesulfonates, tosylate, $C_1$-$C_4$ dialkylphosphates, hydrogen sulfate or tetrachloroaluminate.

Particularly preferred anions are $SCN^-$, $CH_3CH_2SO_4^-$, $N(CN)_2^-$, or $CH_3SO_3^-$.

Cations and anions which form at least one salt are present in the ionic liquid.

Very particularly preferably, the anions and cations of the ionic liquid present in the magnetorheological formulation according to the invention form at least one salt selected from the group consisting of 1-butyl-3-methylimidazolium methylsulfate, 1-ethyl-3-methylimidazolium ethylsulfate, 1-ethyl-3-methylimidazolium dicyanamide, 1-ethyl-3-methylimidazolium n-butylsulfate, 1-ethyl-3-methylimidazolium n-hexylsulfate, 1-ethyl-3-methylimidazolium n-octylsulfate, 1-ethyl-3-methylimidazolium thiocyanate, 1-butyl-3-methylimidazolium thiocyanate, 1-ethyl-3-methylimidazolium tetrachloroaluminate, 1-butyl-3-methylimidazolium tetrachloroaluminate, 1-ethyl-3-methylimidazolium acetate, 1-butyl-3-methylimidazolium acetate, 1-ethyl-3-methyl-pyridinium ethylsulfate, 1-ethyl-3-methylpyridinium nonaflate, 1-ethyl-3-methyl-imidazolium tetrafluoroborate, 1-butyl-3-methylimidazolium tetrafluoroborate, 1-hexyl-3-methylimidazolium tetrafluoroborate, 1-methyl-3-octylimidazolium tetrafluoroborate, 1-methyl-3-octylimidazolium hexafluorophosphate, 1-ethyl-3-methylimidazolium hexa-fluorophosphate, 1-hexyl-3-methylimidazolium hexafluorophosphate, methyltrioctyl-ammonium bis(trifluoromethylsulfonyl) imide, 1-ethyl-3-methyl imidazolium 2-(2-methoxyethoxy) ethylsulfate, 1-ethyl-3-methylimidazolium diethylphosphate, tris(2-hydroxyethyl)methylammonium methylsulfate and 1-ethyl-3-methylimidazolium hydrogensulfate.

Magnetizable particles are present in the magnetorheological formulation according to the invention. These may be any desired magnetizable particles known in the prior art.

The magnetizable particles present in the magnetorheological formulation according to the invention have a mean diameter of 0.1 to 500 μm, preferably from 0.1 to 100 μm, particularly preferably from 1 to 50 μm. The shape of the magnetizable particles may be uniform or irregular. For example, they may be spherical, rod-shaped or acicular particles. Magnetizable particles of substantially spherical form are preferably used. Approximately spherical particles can be obtained, for example, by atomizing molten metals (atomized powders).

For the present invention, it is also possible to use mixtures of magnetizable particles, in particular of magnetizable particles having different particle size distribution and/or comprising different materials.

The magnetorheological formulation according to the invention preferably comprises magnetizable particles selected from the group consisting of iron-containing particles, nickel-containing particles and cobalt-containing particles. These are, for example, particles of iron, iron alloys, iron oxides, iron nitrite, iron carbide, carbonyl iron, nickel, cobalt, stainless steel, silicon steel, alloys or mixtures thereof. However, particles comprising, for example, chromium dioxide may also be present.

The magnetizable particles may have a coating; for example, an iron powder coated with insulating or corrosion-preventing inorganic substances, e.g. silicates, phosphates, oxides, carbides or nitrides, with other metals or with at least one polymer can be used.

According to a particularly preferred embodiment of the present invention, carbonyl iron powder (CIP) particles are present as magnetizable particles in the magnetorheological formulation. The carbonyl iron powder is preferably prepared by decomposition of iron pentacarbonyl. Various types of CIP are known to the person skilled in the art. In addition to the hard CIP types obtained from thermal deposition, reduced carbonyl iron powders may also be used. Such powders are less abrasive and are mechanically softer. Surface-treated types are derived from hard and reduced CIP varieties in various ways. The treated carbonyl iron powders most commonly used are silicate- or phosphate-coated, but other modifications are also obtainable. A further criterion for differentiating between carbonyl iron powders is the respective size distribution of the particles, which can have a substantial influence on the performance characteristics. The dispersed carbonyl iron powder particles preferably have a mean diameter of from 1 to 30 μm. In principle, all carbonyl iron powder varieties are suitable for the invention. The exact choice depends on the conditions of use for the magnetorheological formulation according to the invention.

In the magnetorheological formulation according to the invention, the magnetizable particles are preferably present in a proportion of from 50% by weight to 90% by weight, particularly preferably from 70% by weight to 88% by weight, based on the total weight of the magnetorheological formulation.

According to one variant of the present invention, the magnetorheological formulation comprises at least one additive in addition to the ionic liquid. The additive is preferably selected from the group consisting of thixotropic agents, viscosity modifiers, thickeners, dispersants, surface-active additives, antioxidants, slip agents/lubricants and corrosion inhibitors.

Viscosity modifiers may be solvents or polymeric additives which are soluble in the ionic liquid and change the viscosity of the formulation. For example, polar solvents, such as water, acetone, acetonitrile, low molecular weight alcohols, amines, amides, DMF or DMSO, or polymeric additives, such as, for example, unmodified or modified polysaccharides, polyacrylates and polyureas, are suitable.

If the magnetorheological formulation according to the invention comprises additives serving as viscosity modifiers, these are preferably present in a concentration of from 0.01 to 49% by weight, particularly preferably from 0.01 to 30% by weight, in particular from 0.05 to 10% by weight, based in each case on the total weight of the ionic liquid and additives.

A thixotropic agent is an additive which establishes a flow limit and thus counteracts sedimentation of the magnetizable particles in the liquid present in the magnetorheological formulation. The magnetorheological formulation according to the invention may comprise, for example, at least one thixotropic agent which is selected from the group consisting of natural and synthetic sheet silicates of the smectite group (if appropriate, hydrophobically modified sheet silicates, for example of the montmorillonite type, as disclosed in WO 01/03150 A1), silica gel or (amorphous) disperse silica (as disclosed in U.S. Pat. No. 5,667,715), fibrous silicates (e.g. micronized sepiolites and attapulgites), carbon particles (as disclosed in U.S. Pat. No. 5,354,488) and polyureas (as disclosed in DE 196 54 461 A1). It is also possible to use thixotropic agents based on polymeric carbohydrates, such as, for example, xanthan-galactomannan derivatives, guar derivatives and anionic or nonionic cellulose ethers or starch ethers.

Examples of sheet silicates which may be used are bentonite, montmorillonite, hectorite or synthetic sheet silicates, such as Laponite® from Rockwood Additives Ltd., and hydrophobically modified variants thereof. Since the polarity of the liquid present in the magnetorheological formulation is very high owing to the character of the ionic liquid it is possible to use, for example, simple sheet silicate thickeners which result in reduced sedimentation of the magnetizable particles. The use of sheet silicates which are hydrophobically modified and hence adapted to hydrophobic base oils, such as poly-α-olefins and silicones is therefore possible but not absolutely essential.

If the magnetorheological formulation according to the invention comprises additives serving as thixotropic agents, these are preferably present in a concentration of from 0.01 to 10% by weight, particularly preferably from 0.01 to 5% by weight, in particular from 0.05 to 1% by weight, based in each case on the magnetorheological formulation.

A dispersant is an additive which improves the redispersibility of the magnetizable particles in the liquid present in the magnetorheological formulation after their sedimentation and prevents the agglomeration thereof. Owing to the polar character of ionic liquids, dispersants can be dispensed with in the dispersing of magnetizable particles having a hydrophilic surface, for example of iron particles, in the liquid of a magnetorheological formulation according to the invention. In this case, chemical or physical changes in the magnetorheological formulation, which occur, for example, after long-term or continuous stress and are due to the dispersant, do not take place. However, dispersants can also be used in the magnetorheological formulation according to the invention, for example polymeric dispersants, such as polysaccharides, polyacrylates, polyesters, in particular polyhydroxystearic acid, alkyd resins, long-chain alkoxylates, and furthermore polyalkylene oxides, such as, for example, Pluronic® from BASF AG, which are polyethylene oxide/polypropylene oxide/polyethylene oxide block copolymers and polypropylene oxide/polyethylene oxide/polypropylene oxide block copolymers. Possible dispersants are furthermore anionic, cationic, amphoteric and nonionic surfactants which are known to the person skilled in the art and do not have to be mentioned specifically. Sugar surfactants and alcohol alkoxylates may be mentioned by way of example for nonionic surfactants, anions of carboxylic acids, e.g. oleates and stearates, alkylsulfates, alkyl ether sulfates, alkylphosphates, alkyl ether phosphates and alkanesulfonates, may be mentioned as examples of anionic surfactants and the alkylamine oxides may be mentioned as examples of amphoteric or zwitterionic surfactants.

If the magnetorheological formulation according to the invention comprises additives serving as dispersants, these are preferably present in a concentration of from 0.01 to 5% by weight, particularly preferably from 0.05 to 1% by weight, based in each case on the magnetorheological formulation.

The magnetorheological formulation according to the invention may optionally comprise other additives, for example antislip agents, such as Teflon powder, molybdenum sulfite or graphite powder, corrosion inhibitors, antiwear additives and antioxidants.

According to a preferred embodiment of the present invention, the ionic liquid present in the magnetorheological formulation has a kinematic viscosity of <5000 mPa·s, preferably of <1000 mPa·s, particularly preferably of <200 mPa·s (preferably measured according to DIN 51562 or ISO 3105 using an Ubbelohde viscometer of type 501 from Schott), at 25° C. Furthermore, the ionic liquid of the magnetorheological formulation preferably has a viscosity of <20 000 mPa·s, particularly preferably <10 000 mPa·s, very particularly preferably <2000 mPa·s, at −30° C.

The present invention furthermore relates to a process for the preparation of a magnetorheological formulation according to the invention by dispersing the magnetizable particles in a liquid which comprises an ionic liquid comprising anions and cations.

The preparation is effected, for example, in such a way that the ionic liquid is initially taken and, if appropriate, provided with additives. Before the ionic liquid is mixed with other constituents of the magnetorheological formulation it can be heated in order to reduce its viscosity. For the preparation of the magnetorheological formulation, the magnetizable particles are dispersed in the liquid comprising the ionic liquid. However, it is alternatively possible to stir the magnetizable particles into the ionic liquid and only thereafter to add additives. The homogenization of the magnetorheological formulation is effected, for example, with the aid of a suitable stirring unit. The resulting magnetorheological formulation is optionally degassed under reduced pressure.

The present invention furthermore relates to the use of the magnetorheological formulation according to the invention for applications in controllable apparatuses, such as shock absorbers, clutches, brakes and other devices, such as, in particular, haptic devices, crash absorbers, steer-by-wire steering systems, gear- and brake-by-wire systems, seals, retention systems, prostheses, fitness devices or bearings.

The invention is explained in more detail below with reference to examples.

A) THREE EXAMPLES OF MAGNETORHEOLOGICAL FORMULATIONS ACCORDING TO THE INVENTION AND A COMPARATIVE EXAMPLE

Example 1

Magnetorheological formulation consisting of 19.5% by weight of EMIM $EtSO_4$ (1-ethyl-3-methylimidazolium ethylsulfate), 0.5% by weight of sheet silicate (Laponit® RDS from Rockwood Additives Ltd) as a thixotropic agent and 80% by weight of carbonyl iron powder SQ from BASF AG as magnetizable particles.

Example 2

Magnetorheological formulation consisting of 22.34% by weight of 1-ethyl-3-methylimidazolium thiocyanate, 0.66% by weight of sheet silicate Laponite® RDS from Rockwood Additives Ltd as a thixotropic agent and 77% by weight of carbonyl iron powder having a mean particle diameter of 4 μm as magnetizable particles.

Example 3

23% by weight of 1-ethyl-3-methylimidazolium thiocyanate and 77% by weight of carbonyl iron powder type ON from BASF AG as magnetizable particles.

Comparative Example

23% by weight of poly-α-olefin Durasyn® DS 192 from BASF AG and 77% by weight of carbonyl iron powder type ON from BASF AG.

The properties of the magnetorheological formulations are listed in Tables 1 and 2.

Table 1 comprises the shear stresses τ of the magnetorheological formulations at various temperatures (−30° C. and 25° C.) and shear rates (10 $s^{-1}$ and 100 $s^{-1}$) without a magnetic field and at 25° C. and 1 $s^{-1}$ with a magnetic field (magnetic flux density 0.7 T).

The rheological characterization of the formulation with a magnetic field is effected in a commercial rheometer Physica MCR501 from Anton Paar GmbH, equipped with a magnetic measuring cell MRD 180/1 T, likewise from Anton Paar GmbH. The measurements are effected in a plate-plate arrangement with a 20 mm diameter rotor supplied as standard, and the plate spacing is 0.3 mm. The calibration of the magnetic measuring cell with a sample for determining the magnetic flux density is effected using a Gauss meter from F.W. Bell (model 9500, probe F.W. Bell 1×). After installation of the sample, complete demagnetization of the measuring cell is effected. In order to establish reproducible measuring conditions, the sample is presheared before each measurement at a shear rate of 10 $s^{-1}$ for 20 s, followed by a rest phase of 10 s. At a given current strength of the solenoid, various shear rates are run (e.g. 0.1, 1, 10, 100 $s^{-1}$). After a duration of 10 s, the measured value is taken. Such shear stresses are calculated assuming a Newtonian liquid.

The rheological characterization of the formulation without magnetic field is effected in a cone-and-plate geometry having a diameter of 40 mm and a cone angle of 2° (RheoStress 150 rheometer from Thermo Haake). The measuring mode is shear stress-controlled, and steps in the shear stress are run for the duration of 1 s (typical shear stress ranges are from 0.05 to 2500 Pa) and a flow curve is plotted. The shear stress belonging to the shear rates 10 and 100 $s^{-1}$ is read from said curve.

TABLE 1

| | τ [Pa] 10 $s^{-1}$ −30° C. | τ [Pa] 100 $s^{-1}$ 25° C. | τ [kPa] 1 $s^{-1}$ 0.7 T 25° C. |
|---|---|---|---|
| Example 1 | 270 | 210 | 82 |
| Example 2 | 50 | 25 | 74 |
| Example 3 | 42 | 23 | 68 |
| Comparative example | n.d. | n.d. | n.d. |

n.d. = not determinable since immediate separation occurs

Table 2 comprises data on the flow behavior at −40° C., on the redispersibility, on the redispersibility after 28 days and on the oil separation.

TABLE 2

| | Flow behavior −40° C. | Redispersibility 2000 g; 15 min | Redispersibility after 28 days | Oil separation after 28 days [%] |
|---|---|---|---|---|
| Example 1 | 0 | + | ++ | 11 |
| Example 2 | ++ | ++ | ++ | 15 |
| Example 3 | + | 0 | + | 35 |
| Comparative example | n.d. | −− | −− | 50 |

n.d. = not determinable since immediate separation occurs

Explanation of the Test Methods:

a) Flow Behavior at −40° C.:

The formulation is cooled to −40° C. in a glass jar with a screw cap. Thereafter, the flow behavior is assessed after tilting the glass jar through about 130°. The speed at which a horizontal liquid level forms again in the glass jar is decisive.

++: flows rapidly (low-viscosity)
+: flows slowly (viscous)
0: flows very slowly (glutinous)
−: solid b) Redispersibility (2000 g; 15 Min)

The magnetorheological formulation is centrifuged for 15 minutes in a centrifuge at 4000 rpm. Centrifugal forces of 2000 times the acceleration due to gravity occur here. After the centrifuging, the sediment is tested for redispersibility. For this purpose, a laboratory spatula is inserted into the sediment (to 3 mm above the bottom of the vessel) and turned through 180°. The resistance which acts against the movement of the spatula is qualitatively assessed:

++: resistance very low (very readily redispersible)
+: resistance low (readily redispersible)
0: resistance high (redispersible)
−: resistance very high (poorly redispersible)
−−: spatula can scarcely be turned (not redispersible)

c) Redispersibility after 28 Days:

The magnetorheological formulation is filled to a height of 5 cm into a glass jar having a screw cap. After 28 days, a laboratory spatula is inserted into the formulation to 3 mm above the bottom of the glass jar and turned through 180°. The resistance which acts against the movement of the spatula is qualitatively assessed;

++: resistance very low (very readily redispersible)
+: resistance low (readily redispersible)
0: resistance high (redispersible)
−: resistance very high (poorly redispersible)
−−: spatula can scarcely be turned (not redispersible)

d) Oil Separation:

The magnetorheological formulation is filled into a graduated test tube having a screw cap and the oil separation is read as a percentage after 28 days at 20° C.

B) Experiment and Comparative Experiments for Mass Loss on Heating

Three magnetorheological formulations flowable at −40° C. and having different liquid components (one of them being a magnetorheological formulation according to the invention) were subjected to a thermal gravimetric analysis (TGA) and heated to 250° C. at a rate of 5° C./min in the air (apparatus Netzsch STA 449C). The following mass loss was obtained for the three formulations:

| Base liquid | Weight loss Δm | Assessment for use at high temperatures |
|---|---|---|
| i) Poly-α-olefin (Durasyn 162) | −5.3% (30° C. to 250° C.) | not suitable |
| ii) Silicone oil (Wacker DM5) | −2.0% (30° C. to 250° C.) | not suitable |
| iii) Ionic liquid: 1-ethyl-3-methylimidazolium methylsulfate | −0.9% (30° C. to 250° C.) | suitable |

The three magnetorheological formulations investigated had the following compositions.

i) 9.38% by weight of poly-α-olefin (Durasyn® DS192 from BASF AG) and 90% by weight of carbonyl iron powder type ON from BASF AG and 0.40% by weight of dispersant Disperbyk DB 108 (Byk-Chemie)+0.24% by weight of Bentone SD 3 (Elementis Specialties)

ii) 16.65% by weight of polydimethylsiloxane Wacker DM5+83% by weight of carbonyl iron powder type SQ from BASF AG+0.35% by weight of Bentone SD3 iii) 19.5% by weight of 1-ethyl-3-methylimidazolium ethylsulfate and 80% by weight of carbonyl iron powder type SQ from BASF AG as magnetizable particles and 0.5% by weight of sheet silicate Laponite® SD3 from Rockwood Additives Ltd as a thixotropic agent.

C) Experiment and Comparative Experiments for the Shear Stress at Low Content of Carbonyl Iron Powder (CIP) (about 80% by Weight)

The experiments were carried out at 25° C. at a shear rate of 10 $s^{-1}$.

a) Experiment with magnetorheological formulation according to the invention: 22.34% by weight of 1-ethyl-3-methylimidazolium thiocyanate and 77% by weight of carbonyl iron powder as magnetizable particles and 0.66% by weight of sheet silicate Laponite® RDS from Rockwood Additives Ltd as a thixotropic agent b) First comparative experiment: 17.75% by weight of polydimethylsitoxane Wacker DM5 and 82% by weight of carbonyl iron powder type ON from BASF AG and 0.25% by weight of Bentone SD3.

c) Second comparative experiment: 18.67% by weight of poly-α-olefin (dimer of dodecane) and 80% by weight of carbonyl iron powder type ON from BASF AG and 0.66% by weight of dispersant Borchi Gen BG 911 (Borchers GmbH) and 0.67% by weight of sheet silicate Bentone SD3.

| Magnetic induction/T | a) Shear stress/ kPa | b) Shear stress/ kPa | c) Shear stress/ kPa |
|---|---|---|---|
| 0.00 | 0.0122 | 0.0511 | 0.00320 |
| 0.05 | 1 | 0.762 | 0.469 |
| 0.10 | 3.16 | 2.61 | 1.35 |
| 0.20 | 10.6 | 8.85 | 4.23 |
| 0.30 | 20.7 | 18 | 8.5 |
| 0.40 | 33.0 | 26 | 13.4 |
| 0.50 | 45.7 | 35.3 | 18.1 |
| 0.60 | 59 | 43.5 | 22.4 |
| 0.70 | 70 | 50.4 | 26.1 |
| 0.80 | 75.9 | 54.8 | 29.5 |
| 0.90 | 80.1 | 56.5 | 31.6 |
| 1.00 | 82.6 | 58.1 | 33.1 |

D) Viscosity of Various Ionic Liquids which are Suitable for the Magnetorheological Formulation According to the Invention

| Ionic liquid | Liquid above [° C.] | Viscosity 20° C. [mPa · s] |
|---|---|---|
| 1-Butyl-3-methylimidazolium methylsulfate | <−20 | 214 |
| 1-Ethyl-3-methylimidazolium ethylsulfate | <−20 | 122 |
| 1-Ethyl-3-methylimidazolium dicyanamide | <−20 | 22 |
| 1-Ethyl-3-methylimidazolium n-butylsulfate | 24 | 173 |
| 1-Ethyl-3-methylimidazolium n-hexylsulfate | 7 | 371 |
| 1-Ethyl-3-methylimidazolium n-octylsulfate | −9 | 471 |
| 1-Ethyl-3-methylimidazolium thiocyanate | <−20 | 22 |
| 1-Butyl-3-methylimidazolium thiocyanate | <20 | 54 |
| 1-Ethyl-3-methylimidazolium tetrachloroaluminate | 9 | 26 |
| 1-Butyl-3-methylimidazolium tetrachloroaluminate | −10 | 32 |
| 1-Ethyl-3-methylimidazolium acetate | <20 | 93 |
| 1-Butyl-3-methylimidazolium acetate | <20 | 554 |
| 1-Ethyl-3-methylpyridinium ethylsulfate | <−65 | 152 |
| 1-Ethyl-3-methylpyridinium nonaflate | −6 | 225 |
| 1-Ethyl-3-methylimidazolium tetrafluoroborate | 15 | |
| 1-Butylmethylimidazolium tetrafluoroborate | <−65 | 104 |
| 1-Hexylmethylimidazolium tetrafluoroborate | <−65 | 250 |
| 1-Methyl-3-octylimidazolium tetrafluoroborate | <−65 | 400 |
| 1-Methyl-3-octylimidazolium hexafluorophosphate | <−65 | 900 |
| 1-Ethyl-3-methylimidazolium hexafluorophosphate | <−65 | 560 |
| 1-Hexyl-3-methylimidazolium hexafluorophosphate | <−65 | 900 |
| Methyltrioctylammonium bis(trifluoromethylsulfonyl)imide | <−65 | 630 |
| 1-Ethyl-3-methylimidazolium 2-(2-methoxyethoxy)ethylsulfate | <−65 | 205 |
| 1-Ethyl-3-methylimidazolium diethylphosphate | 20 | 554 |
| 1-Ethyl-3-methylimidazolium hydrogen sulfate | 28 | 4320 |

Ionic liquids which have a viscosity of <1000 mPa·s at 20° C. and which are still liquid at temperatures below −20° C. are particularly preferably used for the magnetorheological formulation of the present invention. These are in particular 1-butyl-3-methyl-imidazolium methylsulfate, 1-ethyl-3-methylimidazolium ethylsulfate, 1-ethyl-3-methyl-imidazolium thiocyanate, 1-butyl-3-methylimidazolium thiocyanate, 1-ethyl-3-methyl-imidazolium acetate, 1-butyl-3-methylimidazolium acetate, 1-ethyl-3-methylpyridinium ethylsulfate, 1-ethyl-3-methylimidazolium dicyanamide, 1-butyl-3-methylimidazolium tetrafluoroborate, 1-hexyl-3-methylimidazolium tetrafluoroborate, 1-methyl-3-octyl-imidazolium tetrafluoroborate, 1-methyl-3-octylimidazolium hexafluorophosphate, 1-ethyl-3-methylimidazolium hexafluorophosphate, 1-hexyl-3-methylimidazolium hexafluorophosphate, methyltrioctylammonium bis(trifluoromethylsulfonyl)imide and 1-ethyl-3-methylimidazolium 2-(2-methoxyethoxy)ethylsulfate.

We claim:

1. A magnetorheological formulation comprising:

(a) an ionic liquid comprising anions and cations, and (b) dispersed magnetizable particles having a mean diameter of 0.1 to 500 μm;

wherein the ionic liquid comprises one or more salts selected from the group consisting of 1-butyl-3-methylimidazolium methylsulfate, 1-ethyl-3-methylimidazolium ethylsulfate, 1-ethyl-3-methylimidazolium thiocyanate, 1-butyl-3-methylimidazolium thiocyanate, 1-ethyl-3-methylpyridinium ethylsulfate, 1-butyl-3-methylimidazolium tetrafluoroborate, 1-hexyl-3-methylimidazolium tetrafluoroborate, 1-methyl-3-octylimidazolium tetrafluoroborate, 1-methyl-3-octylimidazolium hexafluorophosphate, 1-ethyl-3-methylimidazolium hexafluorophosphate, 1-hexyl-3-methylimidazolium hexafluorophosphate, methyltrioctylammonium bis(trifluoromethylsulfonyl) imide, 1-ethyl-3-methylimidazolium 2-(2-methoxyethoxy)ethylsulfate and mixtures thereof, wherein said ionic liquids are still liquid at temperatures below −20° C.

2. The magnetorheological formulation according to claim 1, wherein the magnetorheological formulation further comprises at least one additive selected from the group consisting of thixotropic agents, viscosity modifiers, thickeners, dispersants, surface-active additives, antioxidants, antislip agents/lubricants, corrosion inhibitors and mixtures thereof.

3. The magnetorheological formulation according to claim 2, wherein the ratio of the proportion by weight of the ionic liquid to the proportion by weight of the at least one additive, based in each case on the total weight of the magnetorheological formulation, is greater than 1.

4. The magnetorheological formulation according to claim 3, wherein the dispersed magnetizable particles comprise one or more selected from the group consisting of iron-containing particles, nickel-containing particles and cobalt-containing particles.

5. The magnetorheological formulation according to claim 4, wherein the dispersed magnetizable particles comprise carbonyl iron particles having a mean diameter of from 1 to 30 μm.

6. The magnetorheological formulation according to claim 2, wherein the dispersed magnetizable particles comprise one or more selected from the group consisting of iron-containing particles, nickel-containing particles and cobalt-containing particles.

7. The magnetorheological formulation according to claim 2, wherein the dispersed magnetizable particles comprise carbonyl iron particles having a mean diameter of from 1 to 30 μm.

8. The magnetorheological formulation according to claim 2, wherein the ratio of the proportion by weight of the ionic liquid to the proportion by weight of the at least one additive, based in each case on the total weight of the magnetorheological formulation, is greater than 2.

9. The magnetorheological formulation according to claim 2, wherein said magnetizable particles are present in a proportion of from 50% by weight to 90% by weight and said additive is present in a concentration of from 0.01 to 49% by weight in case the additive is a viscosity modifier, from 0.01 to 10% by weight in case the additive is a thixotropic agent, and from 0.01 to 5% by weight in case the additive is a dispersant based in each case on the total weight of the ionic liquid and additives.

10. The magnetorheological formulation according to claim 2, wherein said magnetizable particles are present in a proportion of from 70% by weight to 88% by weight in case the additive is a viscosity modifier, from 0.01 to 10% by weight in case the additive is a thixotropic agent, and from 0.01 to 5% by weight in case the additive is a dispersant and said additive is present in a concentration of from 0.05 to 10% by weight based in each case on the total weight of the ionic liquid and additives.

11. The magnetorheological formulation according to claim 1, wherein the dispersed magnetizable particles comprise one or more selected from the group consisting of iron-containing particles, nickel-containing particles and cobalt-containing particles.

12. The magnetorheological formulation according to claim 1, wherein the dispersed magnetizable particles comprise carbonyl iron particles having a mean diameter of from 1 to 30 μm.

13. A process for the preparation of a magnetorheological formulation according to claim 1, comprising dispersing the magnetizable particles in a liquid comprising the ionic liquid comprising anions and cations.

14. A process for the preparation of a magnetorheological formulation according to claim 11, comprising dispersing the magnetizable particles in a liquid comprising the ionic liquid comprising anions and cations.

15. A process for the preparation of a magnetorheological formulation according to claim 12, comprising dispersing the magnetizable particles in a liquid comprising the ionic liquid comprising anions and cations.

16. A controllable apparatus selected from the group consisting of shock absorbers, clutches, and brakes, wherein the controllable apparatus comprises a magnetorheological formulation according to claim 1.

17. A controllable apparatus selected from the group consisting of fitness devices, haptic devices, retention systems, crash absorbers, steer-by-wire steering systems, gear- and brake-by-wire systems, seals, prostheses and bearings, wherein the controllable apparatus comprises a magnetorheological formulation according to claim 1.

18. A magnetorheological formulation comprising:

(a) an ionic liquid comprising anions and cations, and (b) dispersed magnetizable particles having a mean diameter of 0.1 to 500 μm;

wherein the ionic liquid is 1-ethyl-3-methylimidazoluim ethylsulfate or 1-ethyl-3-methylimidazoluim thiocyanate.

19. A magnetorheological formulation (a) an ionic liquid comprising anions and cations, wherein the ionic liquid is 1-ethyl-3-methylimidazolium ethylsulfate, 1-ethyl-3-methylimidazolium thiocyanate, and (b) dispersed magnetizable particles having a mean diameter of 0.1 to 500 μm, wherein the dispersed magnetizable particles comprise carbonyl iron particles having a mean diameter of from 1 to 30 μμm;

wherein the magnetorheological formulation further comprises at least one additive selected from the group consisting of thixotropic agents, viscosity modifiers, thickeners, dispersants, surface-active additives, antioxidants, antislip agents/lubricants and corrosion inhibitors and mixtures thereof, therein the ratio of the proportion by weight of the ionic liquid to the proportion by weight of the at least one additive, based in each case on the total weight of the magnetorheological formulation, is greater than 1.

* * * * *